US010988332B2

(12) United States Patent
Tanjo et al.

(10) Patent No.: US 10,988,332 B2
(45) Date of Patent: Apr. 27, 2021

(54) PROCESSING APPARATUS AND FEED UNIT

(71) Applicant: SEIKO EPSON CORPORATION, Tokyo (JP)

(72) Inventors: Toru Tanjo, Nagano (JP); Chiaki Shimada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 16/115,616

(22) Filed: Aug. 29, 2018

(65) Prior Publication Data

US 2019/0061392 A1 Feb. 28, 2019

(30) Foreign Application Priority Data

Aug. 31, 2017 (JP) ..... JP2017-167314
Apr. 26, 2018 (JP) ..... JP2018-085175

(51) Int. Cl.

| | |
|---|---|
| ***B65H 1/26*** | (2006.01) |
| ***B41J 13/00*** | (2006.01) |
| ***B41J 11/58*** | (2006.01) |
| ***B65H 3/06*** | (2006.01) |
| ***B65H 7/14*** | (2006.01) |
| ***B65H 1/02*** | (2006.01) |
| ***B41J 11/00*** | (2006.01) |

(52) U.S. Cl.

CPC ..... *B65H 1/266* (2013.01); *B41J 11/0045* (2013.01); *B41J 11/58* (2013.01);
(Continued)

(58) Field of Classification Search

CPC ..... B65H 1/02; B65H 1/022; B65H 1/025; B65H 1/027; B65H 1/04; B65H 1/26;
(Continued)

(56) References Cited

U.S. PATENT DOCUMENTS 4,039,180 A * 8/1977 Stocker ..... B65H 1/02 271/10.04
4,671,504 A * 6/1987 Lapinski ..... B65H 1/02 271/126

(Continued)

FOREIGN PATENT DOCUMENTS

JP 07-187410 A 7/1995
JP 10-194553 A 7/1998

(Continued)

OTHER PUBLICATIONS

The Extended European Search Report for the corresponding European Patent Application No. 18191631.3 dated Feb. 1, 2019.

*Primary Examiner* — Prasad V Gokhale
(74) *Attorney, Agent, or Firm* — Global IP Counselors, LLP

(57) ABSTRACT

There is provided a processing apparatus including: a processing unit that performs a predetermined process on a medium; a placement unit on which the medium is placed in a first posture; a medium feeding unit that feeds the medium from the placement unit toward the processing unit; and a feed unit that is detachably disposed on the placement unit. The feed unit causes the medium to be placed in a second posture which is different from the first posture. The first posture is a posture in which a surface of the medium is placed along a placement surface of the placement unit, and the second posture is a posture in which sides of a plurality of media are brought into contact with the placement surface of the feed unit.

17 Claims, 21 Drawing Sheets

(52) U.S. Cl.
CPC ..... *B41J 13/0045* (2013.01); *B65H 1/022* (2013.01); *B65H 1/025* (2013.01); *B65H 1/027* (2013.01); *B65H 3/0661* (2013.01); *B65H 3/0669* (2013.01); *B65H 7/14* (2013.01); *B65H 2402/10* (2013.01); *B65H 2405/313* (2013.01); *B65H 2407/21* (2013.01); *B65H 2701/1914* (2013.01); *B65H 2701/1916* (2013.01); *B65H 2801/06* (2013.01)

(58) Field of Classification Search
CPC .... B65H 1/266; B65H 3/0661; B65H 3/0669; B65H 2402/10; B65H 2405/10; B65H 2405/12; B65H 2405/20; B65H 2405/21; B65H 2405/212; B65H 2405/214; B65H 2405/31; B65H 2405/313; B65H 2407/21; B65H 2701/1914; B65H 2701/1916
See application file for complete search history.

(56) References Cited

U.S. PATENT DOCUMENTS 5,069,434 A * 12/1991 Sellers ..... G03G 15/6502 271/2
5,116,034 A * 5/1992 Trask ..... B65H 3/44 271/121
5,167,408 A 12/1992 Golicz
5,346,197 A * 9/1994 Takano ..... B65H 1/04 271/9.05
5,494,272 A 2/1996 Golicz
5,823,522 A * 10/1998 Fujiwara ..... G06K 13/16 271/4.08
6,331,001 B1 * 12/2001 Sekiguchi ..... B65H 1/04 271/10.1
7,967,287 B2 * 6/2011 Hamasaki ..... B65H 1/266 271/171
2007/0102869 A1 * 5/2007 Fairweather ..... B65H 1/025 271/145
2012/0299235 A1 11/2012 Schmidt et al.
2017/0267476 A1 * 9/2017 Miyagi ..... H04N 1/00602
2017/0368843 A1 * 12/2017 Yuasa ..... B65H 1/04
2019/0030920 A1 * 1/2019 Mori ..... G03G 21/1604

FOREIGN PATENT DOCUMENTS

JP 11-199113 A 7/1999
JP 2006-027159 A 2/2006
JP 2006168977 A * 6/2006 ..... G03G 15/6514

* cited by examiner

PROCESSING APPARATUS AND FEED UNIT

CROSS REFERENCES TO RELATED APPLICATIONS

The entire disclosure of Japanese Patent Application Nos. 2017-167314, filed Aug. 31, 2017 and 2018-085175, filed Apr. 26, 2018 are expressly incorporated by reference herein.

BACKGROUND

1. Technical Field

The present disclosure relates to a processing apparatus and a feed unit, the processing apparatus including a processing unit that performs a predetermined process on a medium, a placement unit that places the medium, and a medium feeding unit that feeds the medium from the placement unit toward the processing unit.

2. Related Art

An example of such a type of processing apparatus includes an image forming apparatus disclosed in JP-A-2006-27159. JP-A-2006-27159 discloses a structure in which a sheet of paper set on a manual tray is moved to an image forming unit that forms an image, and then the sheet of paper is discharged to a discharge tray. In this structure, the sheet of paper is set in a posture in which a surface of the sheet is placed along a setting surface of the manual tray.

A processing apparatus such as an ink jet printer performs processes on hundreds of or more sheets of paper in series, in some cases. A manual tray has a limit to the number of sheets to be set at once. For example, in a case of thick paper such as a card, about tens of cards are set at most. Therefore, in a case where processes are performed on more sheets than the number of sheets that can be set on the manual tray at once (in other words, the number of placeable sheets), a problem arises in that the manual tray needs to be frequently refilled with sheets of paper.

In addition, this type of processing apparatus makes a progress in increasing a processing speed. Therefore, sheets of paper on the manual tray are fed in a short time due to the increase in the processing speed, and this also results in a problem in that the manual tray needs to be frequently refilled with sheets of paper.

SUMMARY

An advantage of some aspect of the disclosure is to provide a processing apparatus and a feed unit that are capable of easily realizing a state in which more sheets than usual are placed on the same placement unit of media which are processing targets.

According to an aspect of the disclosure, there is provided a processing apparatus including: a processing unit that performs a predetermined process on a medium; a placement unit on which the medium is placed in a first posture; a medium feeding unit that feeds the medium from the placement unit toward the processing unit; and a feed unit that is detachably disposed on the placement unit. The feed unit causes the medium to be placed in a second posture which is different from the first posture.

In a case where the medium, which is the processing target, is placed in a posture in which a surface of the medium is placed along a placement surface of the placement unit and in a case where the medium is placed in a posture in which a side of the medium is in contact with the placement surface, the number of sheets remarkably increases with respect to the same placement area in the case of the latter posture. As described above, a difference in posture makes it possible to increase the number of sheets that can be placed. Hereinafter, this will be referred to as "a principle of increasing the number of placed sheets based on a difference in posture".

In this configuration, the second posture of the medium that is placed on the feed unit is a posture which enables the number of placed sheets to increase more than the first posture of the medium that is placed on the placement unit, by using the principle of increasing the number of placed sheets based on a difference in posture, and thereby it is possible to increase the number of media that are placed on the feed unit more than the number of media that can be placed on the placement unit. In this manner, it is possible to easily realize a state in which more sheets than usual are placed on the same placement unit of media.

In the processing apparatus, the first posture may be a posture in which the surface of the medium is placed along the placement surface of the placement unit (hereinafter, referred to as a "surface placed posture"), and the second posture may be a posture in which, of four sides of the medium, an end side on a downstream side in a transport direction is brought into contact with the placement surface of the feed unit and the medium is inclined (hereinafter, referred to as a "side placed posture").

In this configuration, since the first posture is the "surface placed posture", and the second posture is the "side placed posture, the number of sheets increases remarkably more with respect to the same placement area than the first posture which is the "surface placed posture". In other words, it is possible to easily realize the state in which more sheets than usual are placed on the same placement unit of media which are the processing target.

In the processing apparatus, the feed unit may include a roller that feeds the medium toward the medium feeding unit. The medium having the first posture may be fed out by the medium feeding unit in a state in which a surface of the medium is placed along the placement surface of the placement unit. When the medium having the second posture moves to a position of the roller and passes through the position of the roller, with the end side of the medium on the downstream side sliding on the placement surface of the feed unit, the posture of the surface of the medium may change along the placement surface of the feed unit, and the medium is fed to the medium feeding unit by the roller.

Here, the position, at which the medium is in contact with the roller that feeds the medium toward the medium feeding unit, is a position at which feeding toward the processing unit is started. The "position to start feeding toward the processing unit" means a position on which a feeding force for feeding out one of the media having the second posture, which are placed on the feed unit, toward the processing unit acts.

In this configuration, the plurality of media placed in the second posture which is the "side placed posture" on the feed unit move in the second posture as it is to the "position to start feeding" toward the processing unit. In other words, the media slide and move in a direction intersecting with a direction of the side of the medium. A medium reaching the "position to start feeding" receives the feeding force, in a state in which the medium has the second posture, and is fed out toward the processing unit.

In a state in which the feed unit is detached from the placement unit, the medium having the first posture which is the "surface placed posture" on the placement unit is fed out toward the processing unit by the medium feeding unit.

In the processing apparatus, the feed unit may be configured to have projecting portions on a surface on a side on which the feed unit is in contact with the placement surface of the placement unit, and to be positioned with the projecting portions fitted into recessed portions formed in the placement surface of the placement unit.

In this configuration, the feed unit has the projecting portions on the surface on the side, on which the feed unit is in contact with the placement surface of the placement unit, and is positioned with the projecting portions fitted into the recessed portions present in the placement surface of the placement unit. Therefore, it is possible to easily perform an attachment/detachment operation to and from the placement unit.

The processing apparatus may further include: a pair of first guide portions that guides side ends of the medium having the first posture and is movable in an approaching/separating direction. The recessed portions may be a pair of grooves that guides movement of the first guide portions, and the projecting portions may be a pair of protrusions which are present at positions corresponding to the pair of grooves.

Here, "to guide the side ends of the medium having the first posture" means that the first guide portions guide the side ends of the medium in order to suppress oblique proceeding in a feeding direction when the medium having the first posture is fed out.

In this configuration, since the placement unit of the processing apparatus is positioned by using the pair of guide grooves of edge guides, with the protrusions of the feed unit fitted into the guide grooves, it is easy to design a structure for positioning, and it is also possible to suppress an increase in the number of component members.

In the processing apparatus, the feed unit may be disposed at a position interposed between the pair of first guide portions.

In this configuration, it is possible to effectively use the position interposed between the pair of first guide portions.

In the processing apparatus, the feed unit may include a holding unit that causes the medium to hold the second posture, and the holding unit may be configured to be movable in a direction in which the holding unit approaches or is separated from the medium feeding unit, and to move toward the medium feeding unit whenever one of media having the second posture is fed out by a force of a pressing unit.

In this configuration, the medium having the second posture, which is placed on the feed unit, holds the posture in the holding unit. The holding unit moves toward the medium feeding unit whenever one of media having the second posture is fed out by the force of the pressing unit, that is, moves toward the position to start feeding.

Hence, The medium present at the "position to start feeding" is fed out in a state in which the force of the pressing unit is applied, and it is possible to realize stable feeding.

In the processing apparatus, the feed unit may include a holding unit that causes the medium to hold the second posture. The placement surface of the feed unit may be provided with a downward inclined surface toward the medium feeding unit in a state in which the feed unit is disposed on the placement unit, and the holding unit may move down on the inclined surface whenever one of media in the second posture is fed out by its own weight.

In this configuration, since the holding unit moves down on the inclined surface whenever one of the media having the second posture is fed out due to its own weight, it is possible to omit a member such as a spring that presses the holding unit toward the medium feeding unit.

In the processing apparatus, the feed unit may include a pair of second guide portions that guides side ends of the medium having the second posture and is movable in an approaching/separating direction toward/from the side ends of the medium.

Here, "to guide the side ends of the medium having the second posture" is used to mean both of that the second guide portions guide the side ends of the medium in order to suppress oblique proceeding in the feeding direction when one of the media having the second posture is fed out and that the second guide portions guide the side ends of the medium in order to suppress a positional shift of the medium having the second posture, which is positioned in front of the position to start feeding, in a direction intersecting with a direction toward the position to start feeding.

In this configuration, it is possible to move the pair of second guide portions depending on a width size of the medium that is placed on the feed unit in the second posture, and it is possible to stably guide the media having various width sizes.

In the processing apparatus, the second guide portions may guide the side ends of the medium having the second posture in a longer length on one side of the medium feeding unit than on a side of the other position, in a direction toward the medium feeding unit.

In this configuration, when the media are set on the feed unit in the second posture, it is easy to perform setting work by using the side on which the guide length is short. In addition, the medium present on the side of the medium feeding unit of the set media having the second posture, that is, the medium present at the position to start feeding, has a long guide length, and thus it is possible to effectively suppress oblique proceeding when the medium is fed out.

In the processing apparatus, the feed unit may be unlockably fixable at a predetermined position to which the holding unit is moved in a separating direction from the medium feeding unit.

In this configuration, when the media are set on the feed unit, it is possible to retract the holding unit, and thus it is easy to perform the setting work of the media.

In the processing apparatus, the roller may rotate, with power transmitted thereto from the medium feeding unit.

In this configuration, the roller, which comes into contact with one of the media having the second posture so as to apply the feeding force to the media, rotates, with the power transmitted thereto from the medium feeding unit. Hence, the feed unit does not need to have a dedicated power source, and it is possible to rotate the roller, which plays a role of starting the feeding, in a simple structure.

In the processing apparatus, the medium feeding unit may have a first gear on a shaft of a feed roller which is one constituent member, the feed unit may have a second gear, the first gear and the second gear may intermesh with each other with the feed unit disposed on the placement unit, and the roller may rotate, with power from the medium feeding unit transmitted thereto via the first gear and the second gear.

In this configuration, the feed unit is installed to be disposed on the placement unit, and thereby the first gear on the side of the placement unit and the second gear on the side of the feed unit are in an intermeshing state with each other.

Therefore, it is possible to realize a structure in which a drive force is easily transmitted to the roller on the side of the feed unit.

The processing apparatus may further include: a first optical sensor that performs detection based on irradiation light and reflected light and is disposed on the placement surface of the placement unit; and a first penetrating opening at a position of the holding unit of the feed unit, which corresponds to an optical path of the irradiation light. The first optical sensor may detect that the medium is placed on the feed unit, based on the reflected light with respect to the irradiation light, via the first penetrating opening.

In this configuration, it is possible to easily perform optical detection of the placement of the medium on the feed unit.

The processing apparatus may further include: a second optical sensor that is disposed on a downstream side in a feeding direction from the first optical sensor and on the placement surface of the placement unit, and performs detection based on irradiation light and reflected light; and a second penetrating opening that is disposed on the downstream side from the first penetrating opening of the feed unit. The second optical sensor may detect that feeding of the medium is started by the feed unit, based on the reflected light with respect to the irradiation light, via the second penetrating opening.

In this configuration, it is possible to easily perform optical detection of the start of feeding of the medium by the feed unit.

In the processing apparatus, the feed unit may include a first floating restrainer that restrains a side edge of the medium from floating when the medium having the second posture is fed out.

In this configuration, the first floating restrainer is capable of suppressing the floating of both side edges of the medium that is started to be fed and moved toward the medium feeding unit. In this manner, it is possible to continue stable feeding.

In the processing apparatus, the feed unit may include a second floating restrainer that restrains the central portion of the medium in a width direction from floating when the medium having the second posture is fed out.

In this configuration, the second floating restrainer is capable of suppressing the floating of the central portion of the medium in the width direction, which is started to be fed and moved toward the medium feeding unit. In this manner, it is possible to continue stable feeding.

In the processing apparatus, the feed unit may include a third floating restrainer that restrains the central portion of the medium in a width direction from floating, the medium having the second posture.

In this configuration, the third floating restrainer is capable of suppressing the floating of the central portion of the medium in the width direction, the medium having the second posture. In this manner, it is possible to start stable feeding.

According to another aspect, there is provided a feed unit that is detachably disposed on a placement unit of a processing apparatus that feeds a medium placed on a placement unit to a processing unit and performs a predetermined process. The feed unit causes the medium to be placed in an inclined posture, with an end side on a downstream side in a transport direction of four sides of the medium coming into contact with the feed unit.

This configuration employs a method in which the end side on the downstream side in the transport direction of the four sides of the medium comes into contact with the feed unit, and the medium is placed in the inclined posture. Therefore, it is possible to increase the number of sheets that can be placed in the feed unit, on the basis of the principle of increasing the number of placed sheets based on a difference in posture. Hence, the feed unit having the configuration is attached to an existing processing apparatus or the like, and thereby it is possible to enhance processing performance of the processing apparatus.

The feed unit may further include: a roller that transports the medium, and the roller may rotate by receiving power from the processing apparatus.

In this configuration, the feed unit includes the roller that transports the medium, and the roller rotates by receiving power from the processing apparatus. Therefore, the feed unit does not need to be provided with a dedicated power source, and thus it is possible to suppress an increase in costs of the apparatus. In addition, the roller is interlocked with an operation of the processing apparatus, and thus there is no need to perform accurate control on the side of the feed unit.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, a multifunction type ink jet printer including multi-layer medium cassettes and a manual-feeding medium tray is exemplified as a processing apparatus according to an embodiment of the disclosure. A configuration of the processing apparatus of the disclosure and a configuration and an operation mode of a feed unit of the disclosure, which is detachably disposed on the medium tray of the processing apparatus, will be described in detail with reference to the accompanying drawings.

In the following description, an outline of an overall configuration of the processing apparatus according to the embodiment of the disclosure will be described, first, with reference to FIGS. 1 and 2. Next, a configuration of a placement unit which is an attachment target of the feed unit according to the embodiment of the disclosure will be briefly described. Subsequently, a configuration of the feed unit according to the embodiment of the disclosure, which is used by being attached to the placement unit will be described in detail, then, an operation mode of the processing apparatus according to the embodiment of the disclosure will be described by focusing on an operation mode of the feed unit. Finally, the other embodiment having a partially different configuration from the embodiment will be mentioned.

Figure 1:
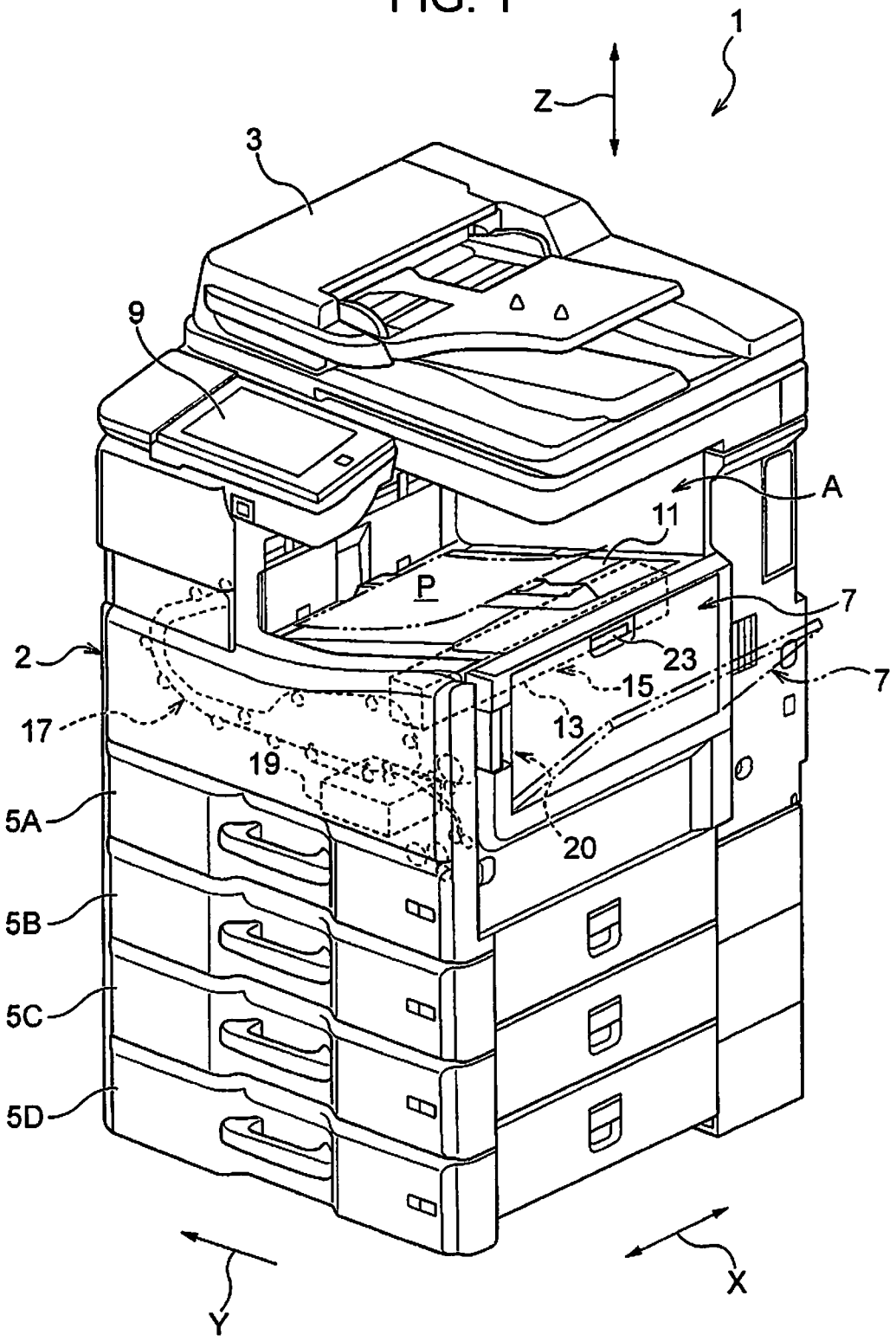
FIG. 1 is a perspective view illustrating an example of a processing apparatus according to an embodiment of the disclosure.
Figure 2:
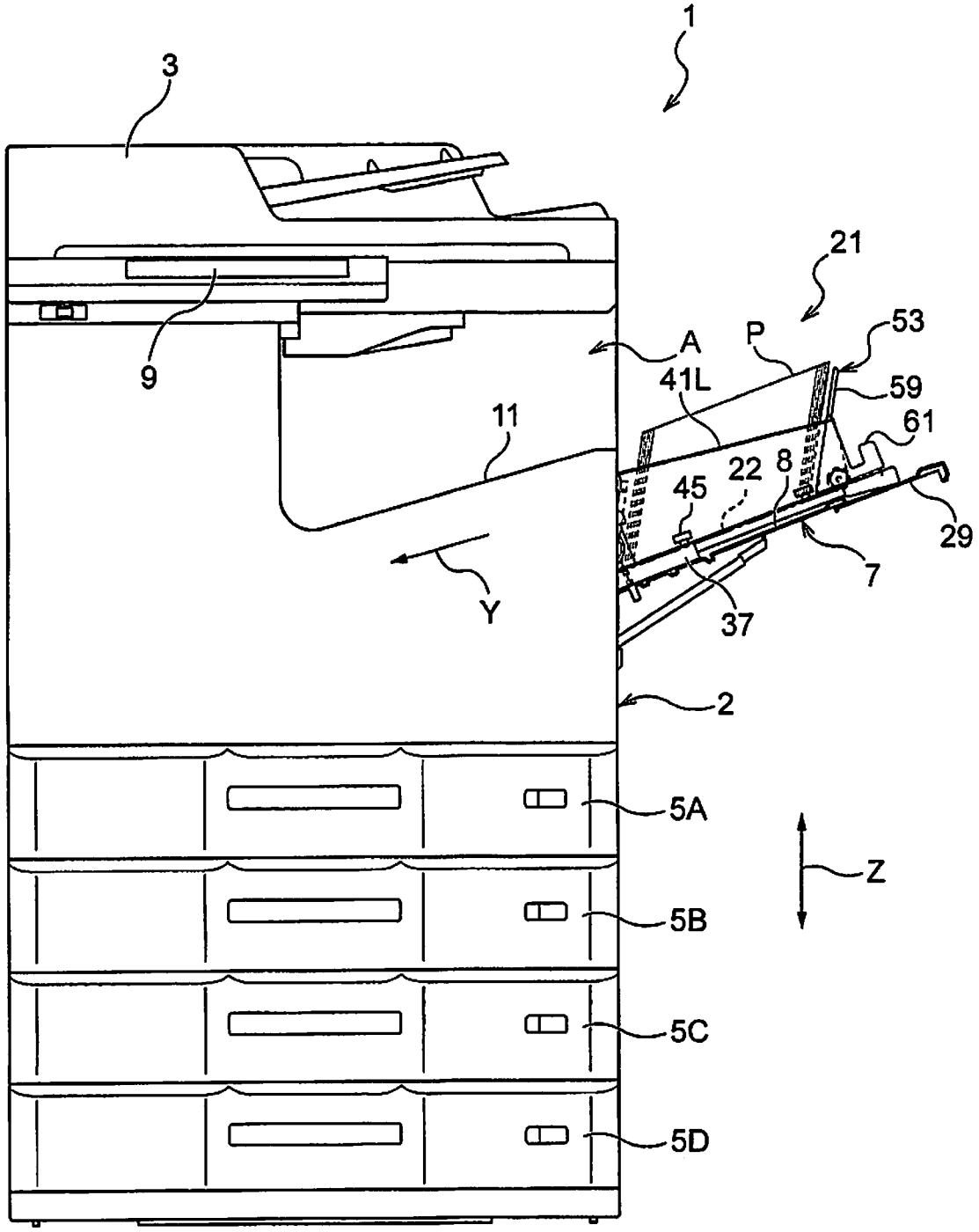
FIG. 2 is a front view illustrating an example of the processing apparatus according to the same embodiment.

(1) Outline of Overall Configuration of Processing Apparatus (Refer to FIGS. 1 and 2)

A processing apparatus 1 in drawings is a multifunction type ink jet printer that includes a scanner 3 above an apparatus main body 2, four layers of medium cassettes 5A to 5D as an example below the apparatus main body 2, and a manual-feeding medium tray 7 on a right side as an example of the apparatus main body 2.

A display operating panel 9, on which various types of settings and operations of the processing apparatus 1 are performed, is provided above the apparatus main body 2, as an example, toward a left side. A large space A for receiving a medium P, on which a process is performed, is formed on a right side toward the display operating panel 9 as an example, and a bottom portion of the space A is a discharge stacker 11.

In addition, the medium cassette 5A having a standard specification, which is included at first on the uppermost layer, is provided in a lower portion of the apparatus main body 2, and the three layers of medium cassettes 5B to 5D for expansion are provided on the layers below the uppermost layer. In addition, the opening lid type manual feeding medium tray 7 is provided as an example on a right side surface toward the apparatus main body 2 as an example.

Further, as illustrated in FIG. 1, the processing apparatus includes a processing unit 13 that ejects liquid droplets in colors (for example, four colors of C (cyan), M (magenta), Y (yellow), and K (black)) on the medium P that is supplied from the medium cassettes 5A to 5D or the medium tray 7 and performs a predetermined process (here, a print process), a transport unit 17 that transports the medium P toward a processing region 15 of the processing unit 13, and a control unit 19 that receives information from an external device such as the display operating panel 9, a personal computer (PC), or the like and controls various types of operations of the processing unit 13 and the transport unit 17, display contents of the display operating panel 9, or the like.

A so-called line head type processing head that performs a process (for example, recording) on an entire region of the medium P in a width direction X intersecting with a transport direction Y at a constant feeding pitch at once, is applicable as the processing unit 13.

It is needless to say that, in a case of the processing apparatus 1 in which a processing quality is more important to a processing speed, a so-called serial head type processing heat, which causes a processing head mounted on a carriage (not illustrated) to make reciprocal movement in the width direction X and performs the predetermined process, is applicable as the processing unit.

As a transport unit 17, a transport unit obtained by making a unit by gathering a nip type feeding roller 18 (a unit which is a "medium feeding unit" to be described below: refer to FIG. 4 to be described below) for transportation or a discharging roller, a motor, a gear train, a belt, or the like which drives the rollers, a guide roller or a guide plate, which guides transport of the medium P, a reversing mechanism that causes the transport direction to be reversed, or the like is applied.

The processing apparatus 1 according to the embodiment is configured to include the processing unit 13 that performs a predetermined process on the medium P, a placement unit (having the same reference sign as the medium tray) 7 that is configured of the medium tray 7 described above, on which the medium P is placed in a first posture, a medium feeding unit 18 (having the same reference sign as the feeding roller) that is configured to have the feeding roller 18 described above, which feeds the medium P from the placement unit 7 toward the processing unit 13, and a feed unit 21 (to be described below) which is detachably disposed on the placement unit 7 and on which the medium P is placed in a second posture.

In the embodiment, the first posture is a posture in which a surface of the medium P is disposed along a placement surface 8 of the placement unit 7. As described above, in this specification, the posture is referred to as a "surface placed posture".

In addition, the second posture is a posture in which sides of a plurality of media P are brought into contact with a placement surface 22 of the feed unit 21. As described above, in this specification, the posture is referred to as a "side placed posture". In the embodiment, more specifically, the "side placed posture" is a posture in which, of four sides of the medium P, a side on a side in the transport direction, that is, a side on a downstream side when the medium is transported, is brought into contact with the placement surface 22, and the medium P is in an inclined state. The posture is an example, and the medium P may have a posture in which the medium stands up to be perpendicular to the placement surface 22. Hence, the feed unit 21, on which multiple sheets of media P can be placed in the side placed posture, is employed, and thereby it is possible to significantly more increase the number of placed sheets of media P, compare to a use state of only the placement unit on which the media P are placed in the surface placed posture.

(2) Configuration of Placement Unit (Refer to FIGS. 3 to 6 and 8)

Figure 4:
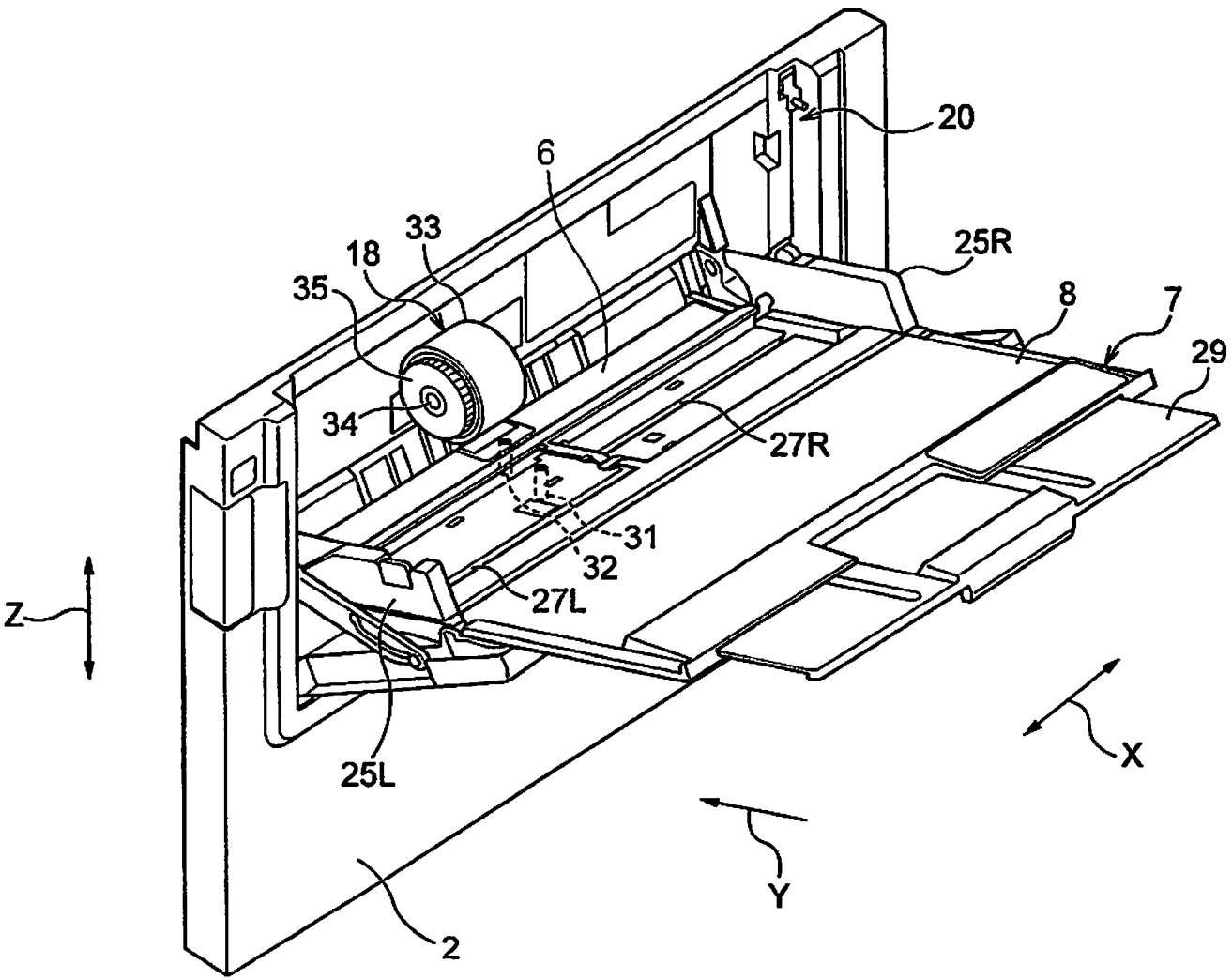
FIG. 4 is a perspective view illustrating a use state of the placement unit of the processing apparatus according to the same embodiment.

The manual-feeding medium tray 7, which is the placement unit 7, is configured to be capable of rotating between a blocking posture in which the medium tray blocks an opening 20 formed in a side surface of the apparatus main body 2 and is parallel to the side surface and a wide-opening posture in which the opening 20 is wide open such that an intersecting angle θ (refer to FIG. 9 to be described below) with the side surface is obtained, around a rotation point provided at a lower end as an example as illustrated in FIG. 4.

The intersecting angle θ with the side surface is about 70° as an example in the embodiment in the drawings.

A front surface of the medium tray 7 is provided with a hand hold portion 23 (FIG. 1), which is a hand hold used when the medium tray 7 is rotated. A back surface of the medium tray 7 is the placement surface 8, on which the medium P is placed in the surface placed posture. On a side of a base portion of the placement surface 8, a pair of first guide portions 25L and 25R (simply assigned with "25" in some cases), which guides side ends of the medium P in the surface placed posture and is capable of approaching and being separated from the side ends in the width direction X that is a frontward-rearward direction as an example in FIG. 4, and a pair of grooves 27L and 27R (simply assigned with "27" in some cases), which guides movement of the first guide portions 25L and 25R.

The pair of grooves 27L and 27R is parallel to the width direction X and is somewhat shifted in the transport direction Y of the medium P, the groove 27L that guides the first guide portion 25L on the left side is positioned in a front side as an example, and the groove 27R that guides the first guide portion 25R on the right side is positioned in a deep side as an example. In addition, an extension tray 29, which is drawn out in the transport direction Y and is capable of performing accommodation, is connected to a front end portion of the medium tray 7.

In addition, as illustrated in FIG. 4, the feeding roller 18, which is a constituent member of the medium feeding unit 18, is provided on a side of a rear surface of the opening 20 formed on the side surface of the apparatus main body 2. A reflection type first optical sensor 31, as an example, is provided at a position toward a deep portion of the medium tray 7 in front of the feeding roller 18, and the first optical sensor detects presence or absence of the medium P that is placed on the feed unit 21 (to be described below) in the side placed posture.

Further, a reflection type second optical sensor 32, as an example, is provided at the center of the medium tray 7 on the deep side, and the second optical sensor detects presence or absence of the medium P that is placed on the placement surface 8 of the medium tray 7 in the surface placed posture of the medium P and detects starting of feeding of the media P that are placed on the feed unit 21 in the side placed posture.

Figure 6:
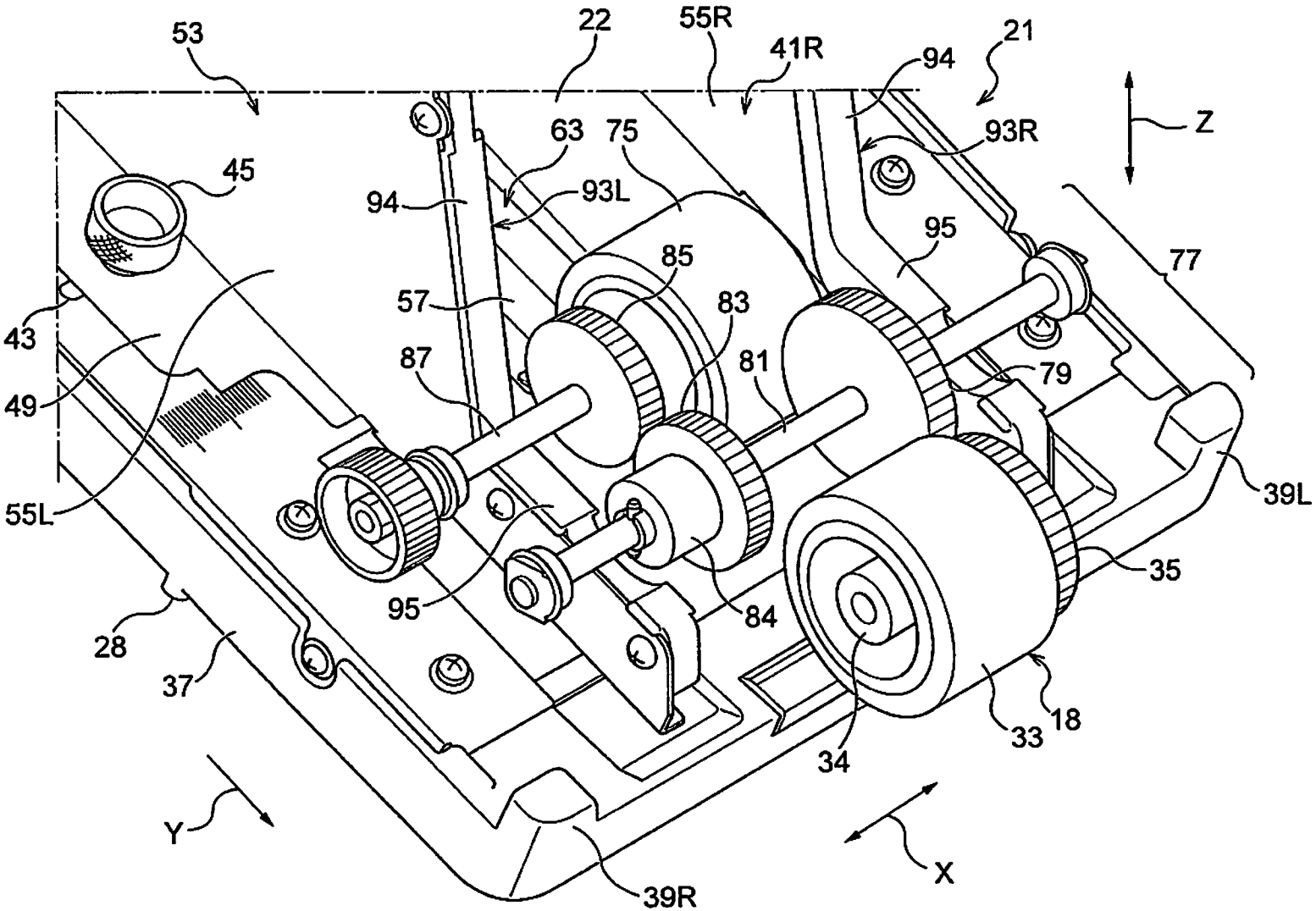
FIG. 6 is a perspective view illustrating a power transmitting unit of the feed unit according to the same embodiment.
Figure 7:
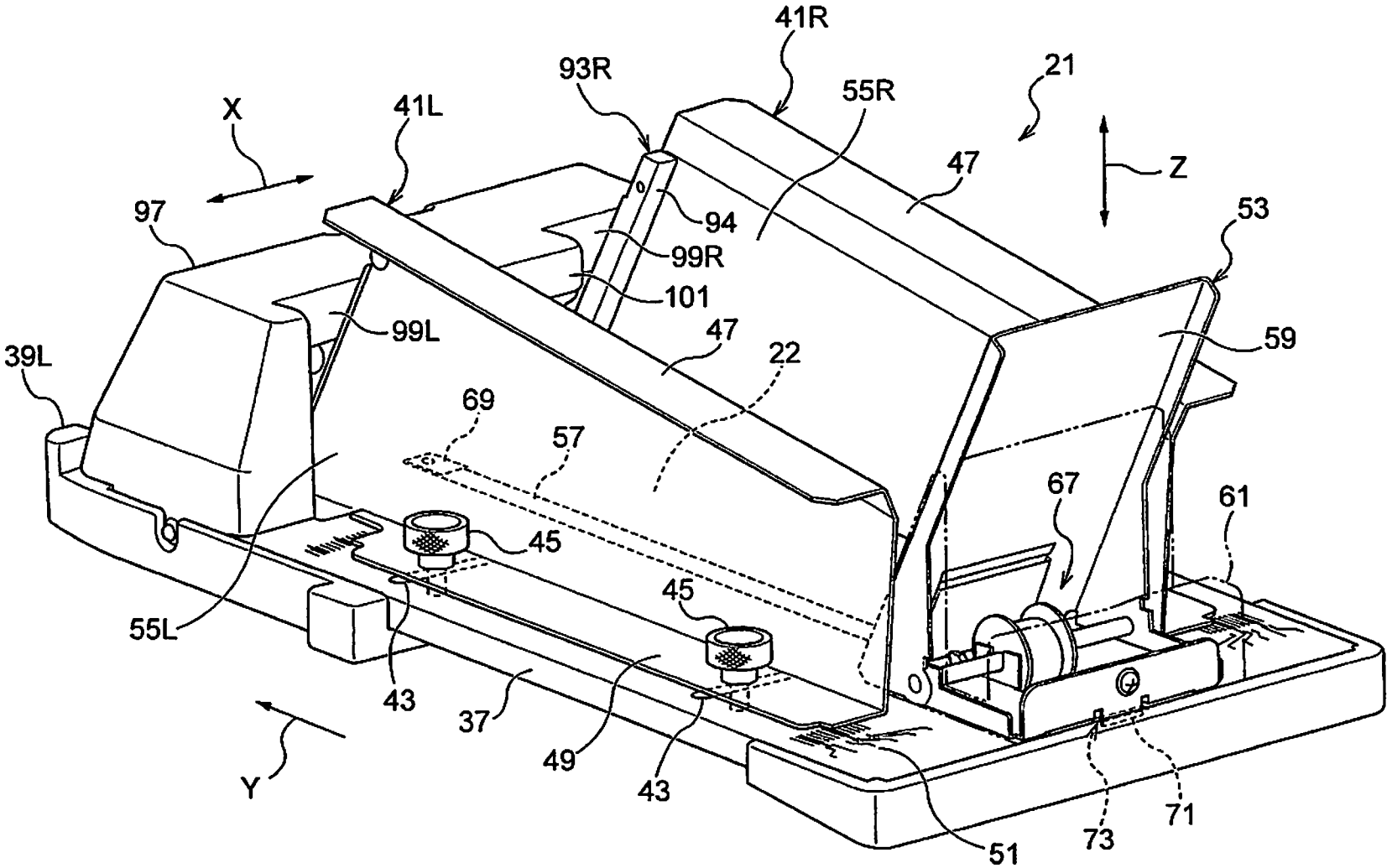
FIG. 7 is a perspective view illustrating the feed unit according to the same embodiment when viewed from obliquely rear on a right side.

In addition, as illustrated in FIG. 6, the feeding roller 18 is configured to have a feed roller 33, which comes into contact with the medium P and performs a direct feeding action, and a first gear 35, which is provided to be coaxial to a shaft 34 that supports the feed roller 33 and integrally rotates along with the feed roller 33. Only a part of the shaft 34 is described in order to avoid complicatedness of the drawings.

In a case where the feed unit 21 is used by being attached to an existing processing apparatus, to which the installation of the feed unit 21 (to be described below) is not scheduled, the feeding roller has only the feed roller 33 that does not have the first gear 35. Therefore, the feeding roller is detached and replaced with the feeding roller 18 that integrally has the first gear 35 in use.

In a case where the media P are placed on the placement unit 7 having such a configuration described above and the process is performed, the media P having the surface placed posture are fed by the medium feeding unit 18 in a state in which a surface of the medium P follows along the placement surface 8 of the placement unit 7, and a predetermined process is performed.

Figure 3:
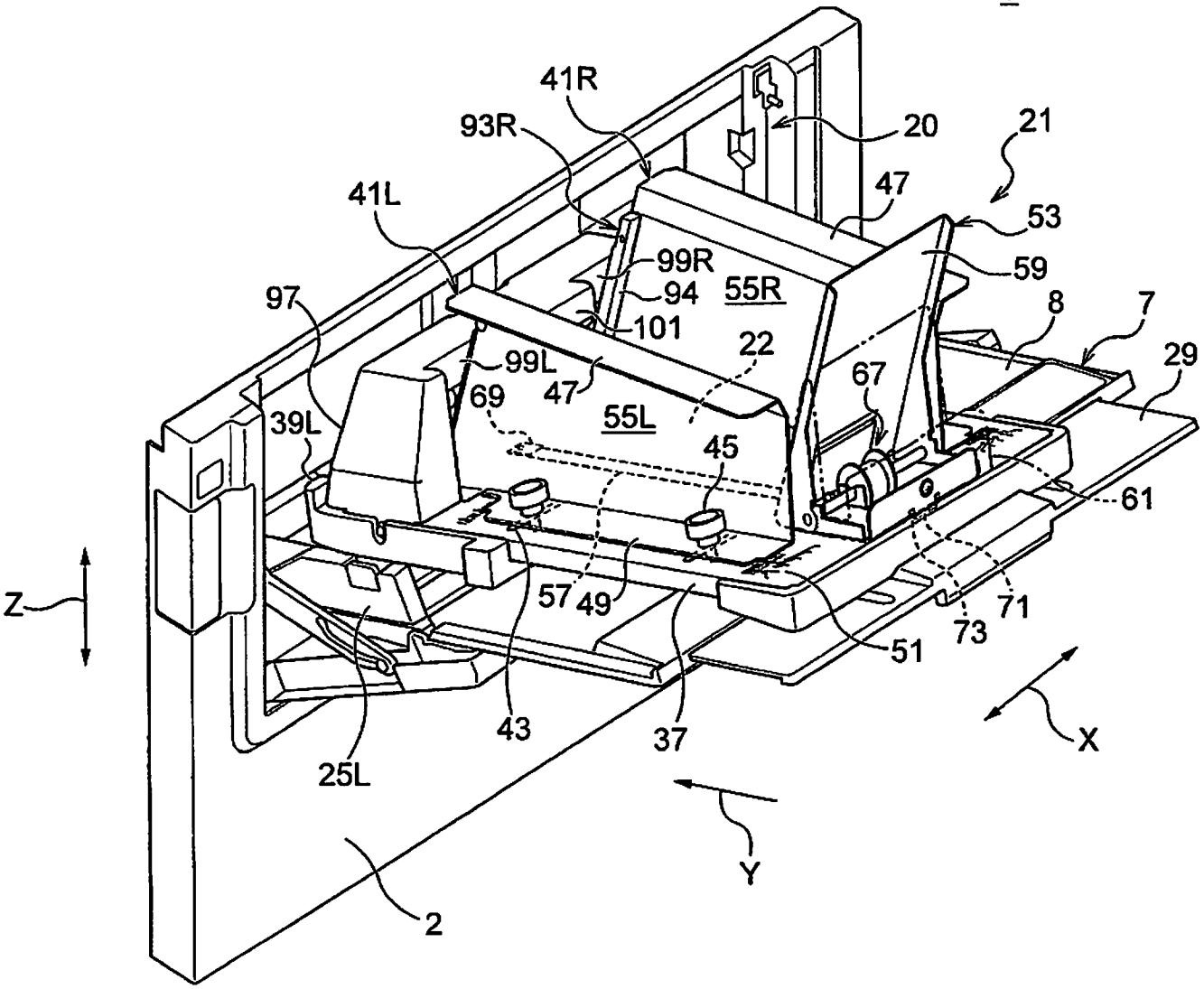
FIG. 3 is a perspective view illustrating a state in which a feed unit is disposed on a placement unit of the processing apparatus according to the same embodiment.

On the other hand, in a case where the feed unit 21 is installed on the placement unit 7 as illustrated in FIG. 3, the medium P is placed on the placement surface 22 of the feed unit 21 in the side placed posture, and the process is performed, a side of the medium P having the side placed posture slides on the placement surface 22 of the feed unit 21, the medium P moves to a position S (FIG. 9) at which feeding toward the processing unit 13 is started, the medium is fed out by the medium feeding unit 18, and a predetermined process is performed on the medium by the processing unit 13.

Figure 8:
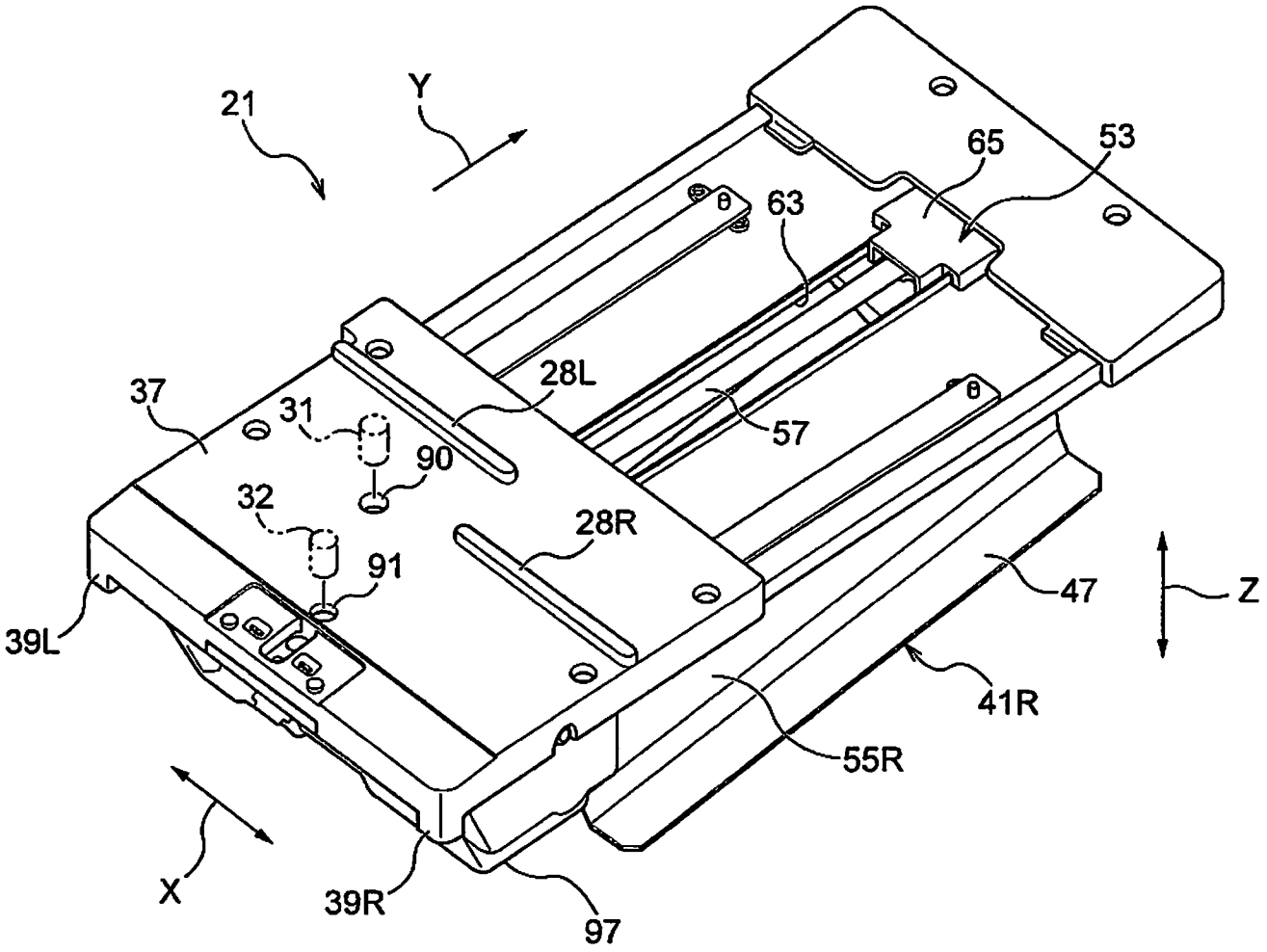
FIG. 8 is a perspective view illustrating the feed unit according to the same embodiment when viewed from obliquely below on a left side.

In a case where the feed unit 21 is installed on the placement unit 7, projecting portions 28 provided on a lower surface of a base frame 37 of the feed unit 21 illustrated in FIG. 8 on a side of being in contact with the placement surface 8 of the placement unit 7 are fitted into recessed portions 27 present in the placement surface 8 of the placement unit 7, and thereby the feed unit is positioned in plane directions X and Y parallel to the placement surface 8.

In the configuration, the recessed portions 27 are the pair of grooves 27L and 27R that guides movement of the first guide portions 25L and 25R in the width direction X, and the projecting portions 28 are a pair of rib-shaped protrusions 28L and 28R (simply assigned with "28" in some cases) present at positions corresponding to the pair of grooves 27L and 27R.

As described above, the feed unit 21 installed on the placement surface 8 of the placement unit 7 is disposed at a position interposed between the pair of first guide portions 25L and 25R.

Figure 5:
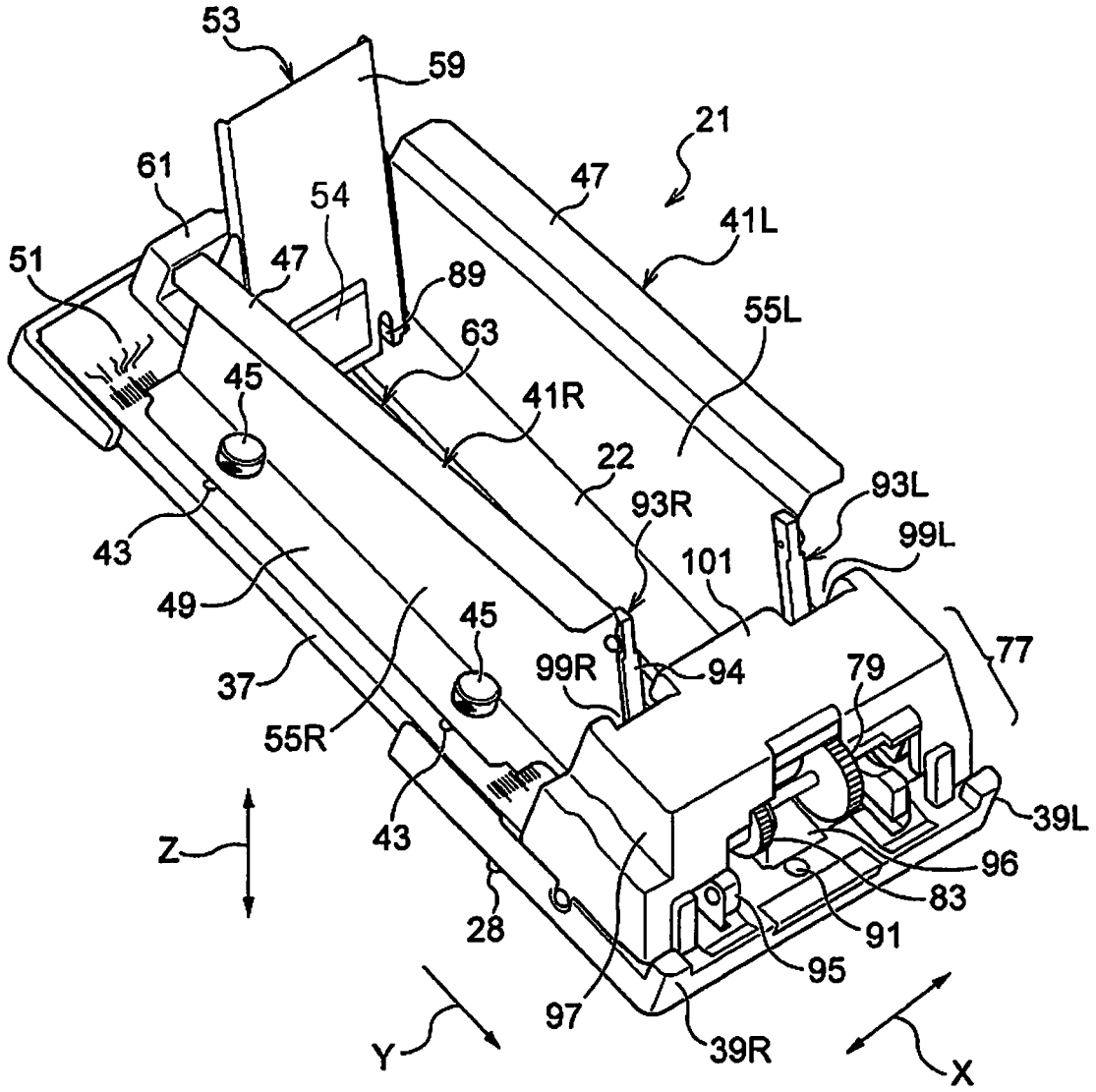
FIG. 5 is a perspective view illustrating the feed unit according to the same embodiment when viewed from obliquely front on a left side.

In a state illustrated in FIG. 3 in which the feed unit 21 is installed on the placement surface 8 of the placement unit 7, protrusions 39L and 39R (simply assigned with "39" in some cases), which are upright on corner portions of the end portions on a mounting side of the base frame 37 of the feed unit 21 illustrated in FIG. 5, abuts on a lower surface of an eave-shaped extending portion (not illustrated), which protrudes from a rear surface of the opening 20 in the side surface of the apparatus main body 2, and thereby the feed unit 21 is prevented from floating up such that the feed unit 21 is positioned in a vertical direction Z.

(3) Configuration of Feed Unit (Refer to FIGS. 3 and 5 to 10)

The feed unit 21 of the embodiment is a feed unit that is detachably disposed on the placement surface 8 of the placement unit 7 and a feed unit that performs a method of performing feeding by placing the media P in the side placed posture in which sides of a plurality of media P are in contact with the placement surface as described above.

The feed unit 21 includes the base frame 37 having a substantially rectangular flat plate shape, and various types of members to be described below are provided on an upper surface of the base frame 37.

First, a pair of second guide portions 41L and 41R (simply assigned with "41" in some cases) are provided at right and left positions toward side end portions of the base frame 37. The second guide portions 41L and 41R are configured of member which guide the right and left side ends of the medium P that is disposed in the side placed posture and configured to be capable of approaching and being separated from the side ends by a predetermined stroke in the width direction X as an example. An interval between the right and left second guide portions 41L and 41R is adjusted in a range of a length of an elongated hole 43 that is formed as an example in the base frame 37. The right and left second guide portions 41L and 41R are fixed to be positioned by tightening four fixing screws 45 having a knob on a head portion thereof, two screws on each of right and left sides.

The second guide portions 41L and 41R are formed by bending both side edges of a metal thin plate as an example in the same direction (in a C shape). An upper bent portion extending outward is a hand hold portion 47 that is held by hand so as to perform an operation in a case where the interval between the second guide portions 41L and 41R is adjusted. In addition, a lower bent portion is a seat plate 49 that is in contact with the upper surface of the base frame 37 and holds the second guide portions 41L and 41R in a standing posture.

A length of the second guide portions 41L and 41R in the transport direction Y is somewhat shorter than a length of the base frame 37 in the transport direction Y. A member of a feeding system is disposed in a space of the second guide portions 41L and 41R on the feeding side and enters a processing region 15 in the apparatus main body 2 of the processing apparatus 1 while the medium P converts the side placed posture into the surface placed posture. On the other hand, a guide scale 51, which performs guiding when the interval between the second guide portions 41L and 41R is adjusted, and a setting space of the holding unit 53 (to be described next) during retraction of the holding unit are formed in a space of the second guide portions 41L and 41R on a front end side (opposite side to the feeding side).

In addition, a guide side plate 55, which connects the hand hold portion 47 and the seat plate 49 of the second guide portions 41L and 41R, is lower in height on the side of the front end and higher in height on the feeding side. In other words, the second guide portions 41L and 41R guide the medium P having the side placed posture in a longer guide length on one side of a position S to start feeding than on a side of the other position, in a direction toward the position S at which the first roller 75 starts feeding the medium P.

In addition, the feed unit 21 according to the embodiment includes the holding unit 53, which causes the medium P to hold the side placed posture, and the holding unit 53 is movable in the transport direction Y in which the holding unit approaches and is separated from the position S to start feeding. The movement of the holding unit 53 is performed by using a restoring force of returning to an original state of a constant load spring 57 in which an elongated leaf spring is wound around into a spiral shape. Hence, the holding unit 53 is pushed to move toward the position S to start feeding by the force of the constant load spring 57 whenever one of the media P having the side placed posture is fed out. The constant load spring 57 is an example of a pressing unit that presses the holding unit 53 toward the position S. A use of the constant load spring as the pressing unit enables the medium P to be pressed to the first roller 75 by a substantially constant pressing force, regardless of the position of the holding unit 53, that is, regardless of the number of sheets of media P having the side placed posture.

In addition, the placement surface 22 (the upper surface of the base frame 37, of which the right and left side surfaces are partitioned by the second guide portions 41L and 41R and a rear surface is partitioned by the holding unit 53) of the feed unit 21, with which the holding unit 53 comes into sliding contact, forms an intersecting angle θ with the side surface of the apparatus main body 2 as described above, the intersecting angle being set to about 70° as an example. Therefore, the placement surface 22 of the feed unit 21 is provided with a downward inclined surface toward the position S to start feeding in a state in which the feed unit 21 is disposed on the placement surface 8 of the placement unit 7. Hence, the media P disposed on the placement surface 22 of the feed unit 21 in the side placed posture moves by receiving a force of moving down along the inclined surface whenever one of the media P having the side placed posture is fed out due to the own weight of the holding unit 53, in addition to the force of the constant load spring 57.

The placement surface 22 of the feed unit 21 is not limited to the downward inclined surface as described above and may be a horizontal surface or an upward inclined surface. In a case of a structure of having the horizontal surface of the upward inclined surface, the action of the "own weight" is not obtained.

In addition, in a case where the placement surface 22 has the downward inclined surface as described above, the holding unit 53 may be configured to move toward the position S only by the own weight of the holding unit 53, that is, the constant load spring 57 as the pressing unit may be omitted in the configuration.

The holding unit 53 is configured to have a rear surface plate 59, which comes into contact with a back surface of the medium P having the side placed posture, and a sliding block 61 (FIGS. 2, 3, and 9) that supports the rear surface plate 59. The rear surface plate 59 is provided to cause an upper side of the medium P to be held in an inclined posture in which the upper side is somewhat displaced to a side of the front end at an inclination angle α of about 60° (FIG. 9) with respect to the placement surface 22 of the feed unit 21.

As illustrated in FIG. 8, the sliding block 61 is a member of which a lower surface is provided with a projecting portion 65, which engages with a guide hole 63 that is formed to extend in the transport direction Y, at the center of the base frame 37 in the width direction X, and in which a winding mechanism 67 (FIGS. 3 and 7) of the constant load spring 57 is provided.

An unwound end 69 (FIGS. 3, 7, and 10) of the constant load spring 57 is fixed to the base frame 37 with a fixing screw (not illustrated) or the like in the vicinity of the position to start feeding of the medium P.

On the other hand, the lower surface of the sliding block 61 including the winding mechanism 67 of the constant load spring 57 is provided with a locking hook 71 (FIGS. 3 and 7) which projects downward. In this configuration, the locking hook 71 is locked to a slit-shaped locking hole 73 that is formed at the central portion toward a rear end of the base frame 37, and thereby it is possible to maintain a state in which the holding unit 53 is retracted rearward.

In this manner, the feed unit 21 is unlockably fixable to the base frame 37 at a predetermined position (the retracted position described above) to which the holding unit 53 is moved in a separating direction from the position S to start feeding.

Next, with reference to FIGS. 6 and 9, the member of the feeding system which is provided in the space on the base frame 37 of the second guide portions 41L and 41R on front side will be described.

The feed unit 21 has, as the member of the feeding system, a first roller 75 that comes into contact with the medium P having the side placed posture so as to apply a feeding force. The first roller 75 is configured to be driven, with power transmitted from the medium feeding unit 18 via the power transmitting unit 77 (FIGS. 5 and 6).

The power transmitting unit 77 is configured as an example to have the first gear 35 that is attached to the shaft 34 of the feed roller 33, which is a constituent member of the medium feeding unit 18, and that integrally rotates along with the feed roller 33, a second gear 79 that intermeshes with the first gear 35, a first intermediate gear 83 that is provided on a shaft 81 of the second gear 79 and integrally rotates along with the second gear 79, and a second intermediate gear 85 that intermeshes with the first intermediate gear 83. In this configuration, the first roller 75 is attached on the shaft 87 of the second intermediate gear 85, and thereby the second intermediate gear 85 and the first roller 75 rotate integrally to each other.

The embodiment can have a configuration in which the number of rotations of the first roller 75 is set to the same number of rotations of the feeding roller 18 as an example; however, the number of rotations of the first roller 75 can be somewhat decreased to be more delayed than the number of rotations of the feeding roller 18, and slight tension is applied to the medium P during the feeding.

In addition, as illustrated in FIG. 6, a torque limiter 84 can be provided on the shaft 81 on which the first intermediate gear 83 and the second gear 79 are provided. The torque limiter 84 adjusts a change in tension of the medium P present between the first roller 75 and the feeding roller 18, the tension being generated due to a difference in the number of rotations or the like between the first roller 75 and the feeding roller 18, and the torque limiter plays a role of realizing good feeding of the medium P. Otherwise, the torque limiter plays a role of suppressing a shift of a feeding start position of the following medium P, which is generated with the following medium P fed by being pulled by the feeding of the preceding medium P. The torque limiter 84 may not be provided.

The feed unit 21 is disposed on the placement surface 8 of the placement unit 7, and thereby the first gear 35 intermeshes with the second gear 79. In this manner, a power transmittable state is obtained.

In addition, as described above (FIGS. 8 and 9), the placement surface 8 of the placement unit 7 is provided with a through-hole 90 at a position somewhat close to the center from a deep portion, and the first optical sensor 31, which performs detection based on the irradiation light and the reflected light, is provided to meet the through-hole 90. In addition, a first penetrating opening 89 (FIGS. 5 and 10) notched into an oval shape as an example is provided as an example of the rear surface plate 59 of the holding unit 53 at a position close to a corner portion at a lower left end in the feed unit 21.

The position of the first penetrating opening 89 is provided to be placed on an optical path (on an optical path passing through the through-hole 90) of a ray from the first optical sensor 31 when the holding unit 53 is moved to be closest to the feeding side. In this manner, in the configuration, in a case where the medium P is present on the placement surface 22 of the feed unit 21, the first penetrating opening 89 is blocked by the medium P, and thereby it is possible to optically detect that the medium P is placed on the feed unit 21. In other words, the first optical sensor 31 detects that the medium P is placed on the feed unit 21 based on the reflected light with respect to the irradiation light, via the first penetrating opening 89.

In a case where the detection is performed by using a transmissive sensor as the first optical sensor 31, a light emitting portion and a light receiving portion need to be provided. The light emitting portion and the light receiving portion are disposed at predetermined positions on the optical path, and thereby it is possible to perform the detection.

In addition, as described above (FIGS. 8 and 9), the second optical sensor 32, which performs detection based on the irradiation light and the reflected light, is provided to meet a downstream position from the position S to start feeding in the feeding direction Y in the feed unit 21 at the center of the deep portion of the placement surface 8 of the placement unit 7. In addition, a second penetrating opening 91 having a circular shape is provided as an example at the center position in the vicinity of the end portion of the base frame 37 on the feeding side in the feed unit 21. Hence, the second penetrating opening 91 is positioned on the downstream side from the first penetrating opening 89 in the feeding direction Y.

The position of the second penetrating opening 91 is provided on an optical path of a ray from the second optical sensor 32. In this manner, in the configuration, the medium P set on the feed unit 21 is fed by the first roller 75 in the feeding direction Y, a leading end of the medium P blocks the second penetrating opening 91, and thereby it is possible to optically detect that the feeding of the medium P is started. In other words, the second optical sensor 32 detects that the feeding of the medium P is started from the position S to start feeding, based on the reflected light with respect to the irradiation light, via the second penetrating opening 91.

In a case where the detection is performed by using a transmissive sensor as the second optical sensor 32, a light emitting portion and a light receiving portion need to be provided. The light emitting portion and the light receiving portion are disposed at predetermined positions on the optical path, and thereby it is possible to perform the detection.

In addition, in the configuration, even in a case where the feed unit 21 is not provided, the medium P is directly mounted on the placement surface 8 of the placement unit 7 in the surface placed posture, and the predetermined process is performed, it is possible to optically detect the presence and absence of the medium P by using the second optical sensor 32.

In addition, edges of the guide side plates 55L and 55R (simply assigned with "55" in some cases) of the second guide portions 41L and 41R are inclined substantially at the same angle as the rear surface plate 59 of the holding unit 53. A pair of floating restraining members 93L and 93R (simply assigned with "93" in some cases) having a substantially L shape in a side view are provided on an inner side of the inclined edge on the feeding side.

A role of the floating restraining members 93L and 93R is described.

In the configuration, when the media P set on the feed unit 21 are pushed by the holding unit 53 and moves, and the frontmost medium P abuts on the first roller 75, a gap T1

(FIG. 9) having a predetermined size is formed between right and left side edges of the frontmost medium P and a rear surface of an inclined portion 94 of the floating restraining member 93 (a side opposite to the frontmost medium P). In a state before the first roller 75 starts the feeding, displacement such as floating and inclination of the medium P is regulated in a range of the gap T1. Hence, when the medium P receives an effect of generating the displacement exceeding the gap T1, the medium P comes into contact with the rear surface of the inclined portion 94 of the floating restraining member 93 such that displacement equal to or greater than the displacement in the gap is regulated. Therefore, it is possible to stabilize a set state of the medium P set on the feed unit 21.

Figure 9:
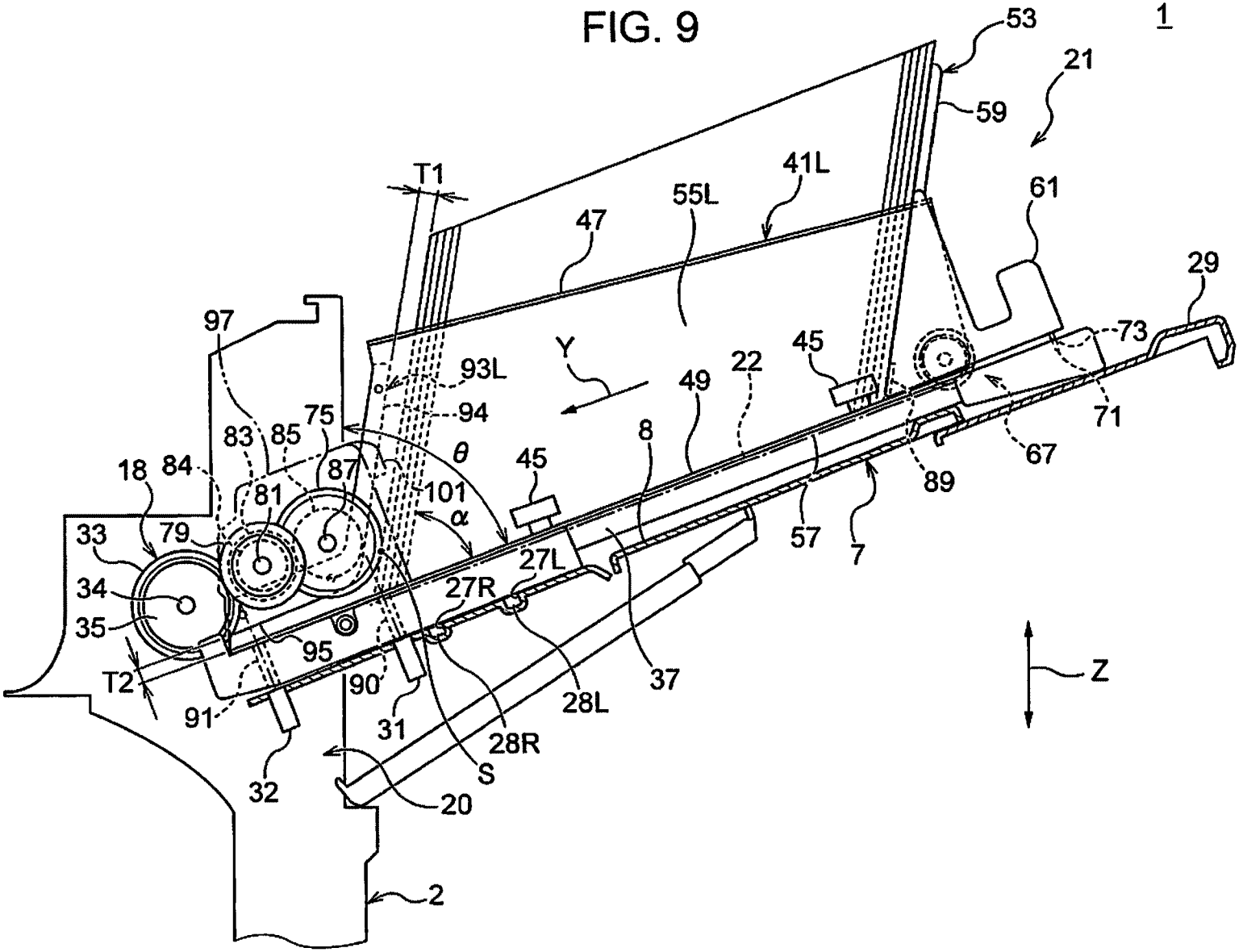
FIG. 9 is a sectional side view illustrating the feed unit according to the same embodiment, on which multiple sheets of media are set.

As illustrated in FIGS. 6 and 9, the floating restraining member 93 has a horizontal portion 95 that is smoothly continuous from the inclined portion 94, and a front end of the horizontal portion 95 extends to be close to the feeding roller 18. A gap T2 (FIG. 9) having a predetermined size is formed between a lower surface of the horizontal portion 95 and the placement surface 22 of the feed unit 21.

When the medium P starts to be fed by the first roller 75, the medium P having the side placed posture is fed while being converted into the surface placed posture by the first roller 75, the medium passes along the lower surface of the horizontal portion 95 of the floating restraining member 93 and reaches a feeding region of the feeding roller 18.

At this time, floating of a side edge portion of the medium P is suppressed in a range of the gap T2 on a side of the lower surface of the horizontal portion 95, on the right and left side edges of the medium P fed and converted into the surface placed posture.

Although a part is repeated, the inclined portion 94 of the floating restraining member 93 stabilizes the set state of the media P set on the feed unit 21 in the side placed posture, in a state before the feeding is started by the first roller 75. For example, in the state in FIG. 9, when the placement unit (medium tray) 7 is lifted, and the set media P in the side placed posture are about to fall forward, the inclined portion 94 prevents the falling. In addition, even in a case where the medium P has low stiffness (the middle portion of the medium is weak), the medium P having the side placed posture is fed out from the position S to start feeding, and a rear side of the medium P is displaced due to oscillation, the displacement is regulated in the range of the gap T1 by the inclined portion 94.

In addition, when the medium P is fed out from the position S to start feeding while being converted from the side placed posture into the surface placed posture, the horizontal portion 95 of the floating restraining members 93 functions as a first floating restrainer that restrains the side edge portion of the medium P from floating.

As illustrated in FIG. 5, when the medium P having the side placed posture is fed from the position S to start feeding, the feed unit 21 is provided with a restraining portion 96 that restrains the central portion of the medium P in the width direction from floating, the medium P fed to be close to the feeding roller 18 by the first roller 75. The restraining portion 96 functions as a second floating restrainer that suppresses the central portion of the medium P, which is being fed, from floating.

In this manner, it is possible to continue stable feeding.

As illustrated in FIG. 5, a housing 97 that covers the power transmitting unit 77 is provided in the feed unit 21. Recessed portions 99L and 99R (simply assigned with "99" in some cases) for avoiding interference between members are formed at portions opposite to inclined edges of the second guide portions 41L and 41R of the housing 97 and the floating restraining members 93L and 93R, and a protruding portion 101, which protrudes toward the side of the media P set on the feed unit 21 in the side placed posture, is provided in a part between the recessed portions 99L and 99R.

The protruding portion 101 functions as a third floating restrainer that suppresses the central portion of the medium P in the width direction from floating, the medium P having the side placed posture at the position S to start feeding. In this manner, it is possible to start stable feeding.

Figure 10:
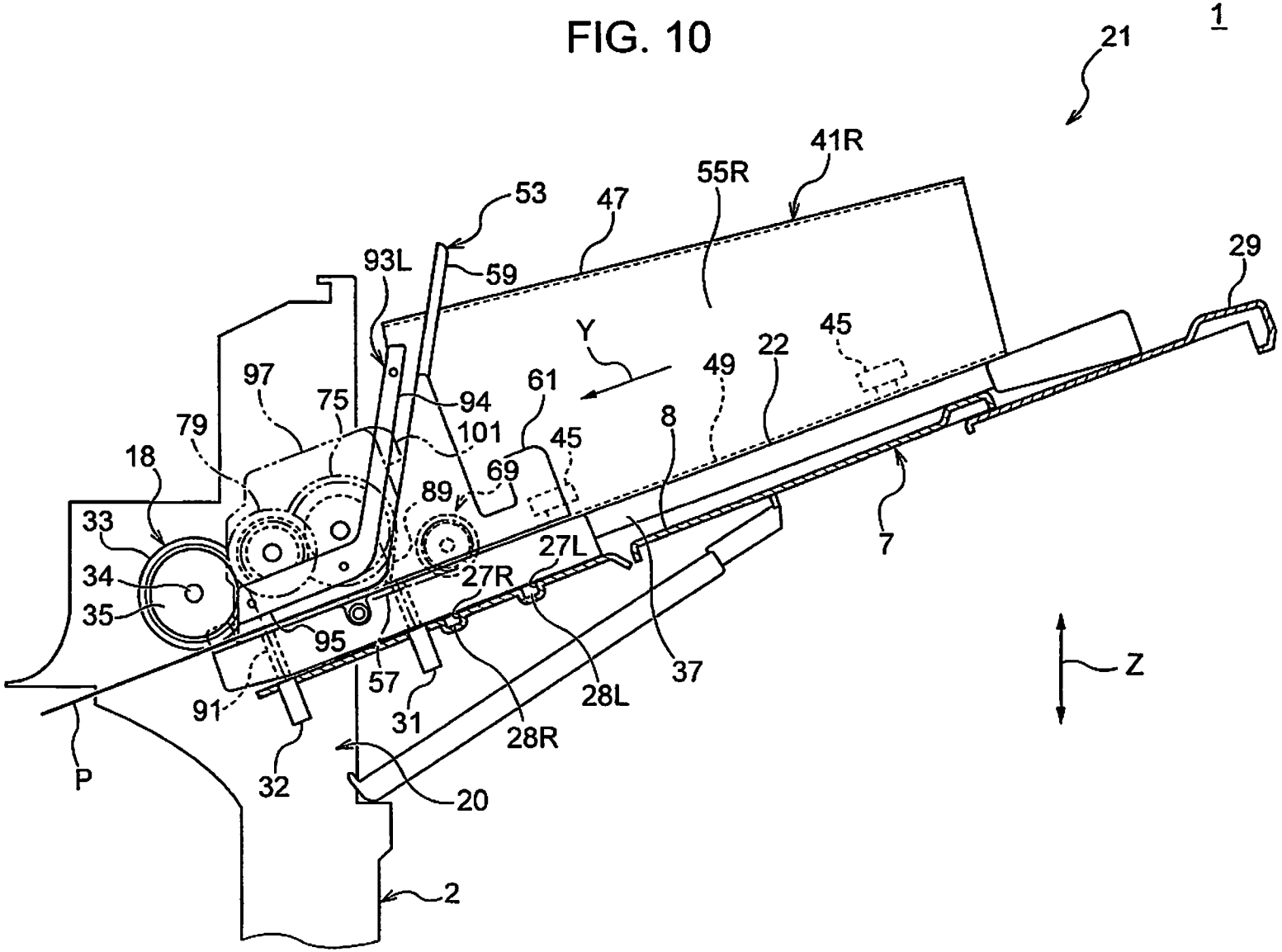
FIG. 10 is a sectional side view illustrating the feed unit according to the same embodiment, on which the last sheet of medium is fed.

(4) Operation Mode of Processing Apparatus (Refer to FIGS. 9 and 10)

Next, a case where a recording process of an address or a sentence is performed on the medium P such as a card or an envelope by using the feed unit 21 is exemplified, and thereby an operation mode of the processing apparatus 1 will be described by focusing on an operation mode of the feed unit 21.

In the following description, the operation mode of the processing apparatus 1 is described by dividing the operation mode into four stages:

(A) Installation of Feed Unit;

(B) Set of Medium;

(C) Start of Feed; and (D) End of Feed.

(A) Installation of Feed Unit (Refer to Mainly FIG. 9)

A hand holds the hand hold portion 23 (FIG. 1) of the front surface of the medium tray 7 that blocks the opening 20 that is formed in the side surface of the apparatus main body 2 such that the medium tray 7 has a wide-opening state, a back surface of the medium tray 7 is out such that the placement surface 8 is exposed (a state in FIGS. 1 and 4).

Next, the feed unit 21 is placed on the placement surface 8, and the protrusions 28L and 28R, which are formed on the lower surface of the base frame 37 of the feed unit 21, are positioned by being fitted into the movement guiding grooves 27L and 27R of the first guide portions 25L and 25R which are formed on the placement surface 8 (FIGS. 2 and 3).

At this time, a side of a feeding end of the feed unit 21 is inserted into the opening 20 in a state in which the feed unit is somewhat inclined downward, and the protrusions 28L and 28R and the grooves 27L and 27R are positioned. Then, the feed unit 21 is installed on the placement surface 8 with the front side of the feed unit 21 being downward toward a lower side.

In this state, the movement of the feed unit 21 on a plane X and Y parallel to the placement surface 8 of the placement unit 7 is regulated by engagement of between the protrusions 28L and 28R and the grooves 27L and 27R, and the floating of the feed unit 21 in the vertical direction Z is regulated by engagement between the protrusions 39L and 39R of the base frame 37 on the side of the feeding end and an extending portion (not illustrated) which is provided on the rear surface of the opening 20.

In addition, when the feed unit 21 is installed on the placement surface 8, the first gear 35, which is integrally provided to the feeding roller 18 which is the constituent member of the medium feeding unit 18, intermeshes with the second gear 79 of the power transmitting unit 77 such that it is possible to transmit power to the first roller 75, and thereby a state in which it is possible to feed the medium P is achieved.

(B) Set of Media (Refer to FIG. 9)

Next, the hand hold portion 47 is held so as to adjust the gap between the second guide portions 41L and 41R, depending on a width side of the medium P on which the process is performed, and the attachment positions of the second guide portions 41L and 41R is fixed by tightening the fixing screws 45. Subsequently, the holding unit 53 is held and pulled rearward in the feeding direction Y in which the retracted position is placed, against the force of the constant load spring 57, the locking hook 71, which projects from the lower end of the sliding block 61 of the holding unit 53, is locked into the locking hole 73 that is provided on the front end portion of the base frame 37, and the holding unit 53 is fixed at the retracted position.

In this state, the necessary number of media P having a side placed posture enters and is set from the side of the front end portion. At this time, the guide side plates 55L and 55R of the second guide portions 41L and 41R is lower in height on the side of the front end side than the feeding side (a guide length is shortened), and thus the medium P is smoothly set.

When the locking hook 71 in a locking state is pulled up from the locking hole 73 such that the locking state is unlocked, a bundle of media P set on the feed unit 21 due to the force of the constant load spring 57 on the feeding side moves by being pushed to the feeding state by the rear surface plate 59 of the holding unit 53. A bundle of the frontmost medium moves to a position which is the position S to start feeding, and the medium comes into contact with the first roller 75 such that the holding unit 53 stops the movement.

In this manner, the medium P has an inclined posture in which an upper end side is somewhat displaced rearward in the feeding direction Y at substantially the same angle as the inclination angle $\alpha$ of the rear surface plate 59, and the lower end side of the medium P is supported by the placement surface 22, and the right and left side edges are guided by the second guide portions 41L and 41R. In addition, the frontmost medium P on the feeding side is in an abutting state on the first roller 75, and preparation of the feeding of the medium P is completed. In this state, the first optical sensor 31 detects the presence of the medium P, and the second optical sensor 32 does not detect the presence of the medium P.

(C) Start of Feed (Refer to FIG. 9)

Next, when the feeding roller 18, which is a constituent member of the medium feeding unit 18, is actuated, power is transmitted to the first roller 75 via the power transmitting unit 77. The first roller 75 starts rotating in the same direction at the same angle as the feeding roller 18, and the frontmost medium P on the feeding side is started to be fed.

When the frontmost medium P on the feeding side gradually changes a posture from the side placed posture, in which the upper end side is inclined somewhat rearward, to a surface placed posture, and the front end portion of the medium P reaches a nip position of the feeding roller 18, the feeding force of the feeding roller 18 is directly transmitted to the medium P such that the medium is fed to the processing region 15 in the apparatus main body 2.

At this time, since the floating or inclination of the side edge portion and the central portion of the medium P, which is generated according to the feeding, is restrained within a predetermined range by the first floating restrainer 95, the second floating restrainer 96, and the third floating restrainer 101, the medium P is smoothly fed without receiving an excessive force.

When the rear end of the frontmost medium P passes over the first roller 75, the bundle of subsequent media P moves to the feeding side by an amount of thickness of the medium P by a force obtained by adding the force of the constant load spring 57 and the own weight of the holding unit 53, and the second medium P from the frontmost medium is in an abutting state on the first roller 75. Hereinafter, the same operation is repeated, and the second medium, the third medium, the number of set media P, or the number of media P, on which the process is performed, are continuously fed. In this state, the second optical sensor 32 detects the presence of the medium P at a timing at which the front end of the frontmost medium P is nipped by the feeding roller 18, and the detection state of the medium P is continuous by the first optical sensor 31 and the second optical sensor 32.

(D) End of Feed (Refer to FIG. 10)

When feeding of the media P set on the feed unit 21 proceeds, and the last medium P passes over the feeding roller 18, the series of feeding by the feed unit 21 is completed, and the first optical sensor 31 and the second optical sensor 32 are in a state in which the sensors do not detect the presence of the medium P.

In addition, in a case where the number of sheets of media P, on which the process is performed, is smaller than the number of sheets set on the feed unit 21, the feeding of the medium P is stopped in a state in which the media P remain on the feed unit 21.

According to the processing apparatus 1 and the feed unit 21 according to the present embodiment having such a configuration, since the second posture of the media P which are mounted on the feed unit 21 is the side placed posture, the number of mounted sheets of the media P can be significantly increased, compared to the surface placed posture which is the first posture of the media P which are disposed on the placement unit 7. Hence, in a high-speed processing apparatus that performs the predetermined process at a high speed, it is possible to perform the processing at once without refilling the multiple media P in the middle of the media P.

Other Embodiments

The processing apparatus 1 and the feed unit 21 according to the disclosure basically have the configuration described above; however, it is needless to say that a partial configuration is changed, omitted, or the like within a range without departing from the gist of the disclosure of the application.

For example, the processing apparatus of the disclosure is not limited to the ink jet printer; however, it is possible to apply the processing apparatus to a laser printer or the like, another recording apparatus, the multifunction printer, or the like, and thus it is possible to apply the processing apparatus to various processing apparatus that performs the constant process on a large number of media P at the high speed and various types of processing apparatus.

In addition, in the embodiment, although the feed unit 21 is installed on the placement unit 7 by using the grooves 27 that guide the movement of the first guide portions 25L and 25R which are provided in an existing placement unit 7, it is possible to provided separate recessed portions 27 and the projecting portions 28 if a dedicated processing apparatus 1 that is scheduled to install the feed unit 21 at first is used.

In a case where a structure of attaching and detaching the feed unit 21 to and from the processing apparatus 1 is not employed, but a processing apparatus that employs an integral structure, it is possible to realize the installation by using the structure of the feed unit.

In addition, in a case where a pressing force due to the own weight of the holding unit 53 acts on the medium P having the side placed posture by employing the inclined surface obtained by inclining the placement surface 22 of the feed unit 21, and it is possible to smoothly move the medium P by the own weight thereof, it is possible to omit the constant load spring 57. In addition, it is possible to use a different type of spring having a different method such as a leaf spring or a coil even as the constant load spring 57, or a spring, and thus it is possible to dispose the weight, which assists the movement of the sliding block 61 in the sliding block.

Otherwise, the configuration of the power transmitting unit 77 is not limited to the configuration having a gear train described above in embodiment, and a configuration, in which a timing belt is used or a separate drive source is provided, may be employed. In addition, the medium P that can be mounted on the feed unit 21 is not limited to the card or an envelope having a vertical orientation, and the medium P may be the card or the envelope having a horizontal orientation and may be another type of medium of a business card or another indefinite shape.

Further, it is possible to provide the sensor, which detects whether or not the feed unit 21 is disposed on the placement unit 7, on the recessed portions 27, the projecting portions 28, and the like.

Hereinafter, specific modification examples of the embodiment described above will be described with reference to the drawings after FIG. 11.

Figure 11:
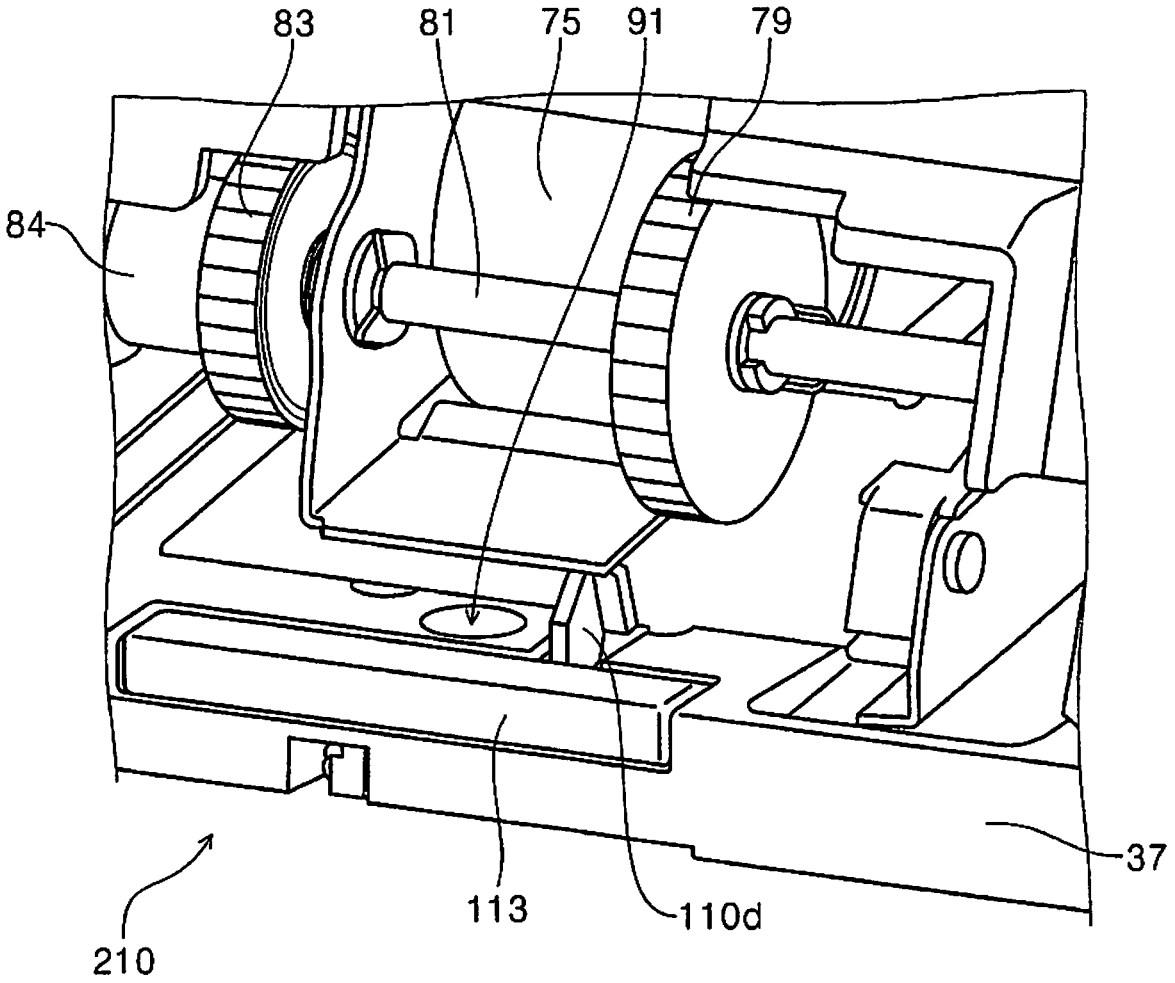
FIG. 11 is a partially enlarged perspective view illustrating a front side of a feed unit according to the other embodiment.

First, with reference to the FIGS. 11 to 16, a modification example in which a sensor lever 110 is provided between the second penetrating opening 91 and the second optical sensor 32. In FIG. 11, the same reference signs are assigned to the same configuration as that of the embodiment described above, and the description is omitted hereinafter.

A feed unit 210, which is a modified state of the feed unit 21, includes the sensor lever 110 between the second penetrating opening 91 and the second optical sensor 32 (FIGS. 9 and 10).

Figure 13:
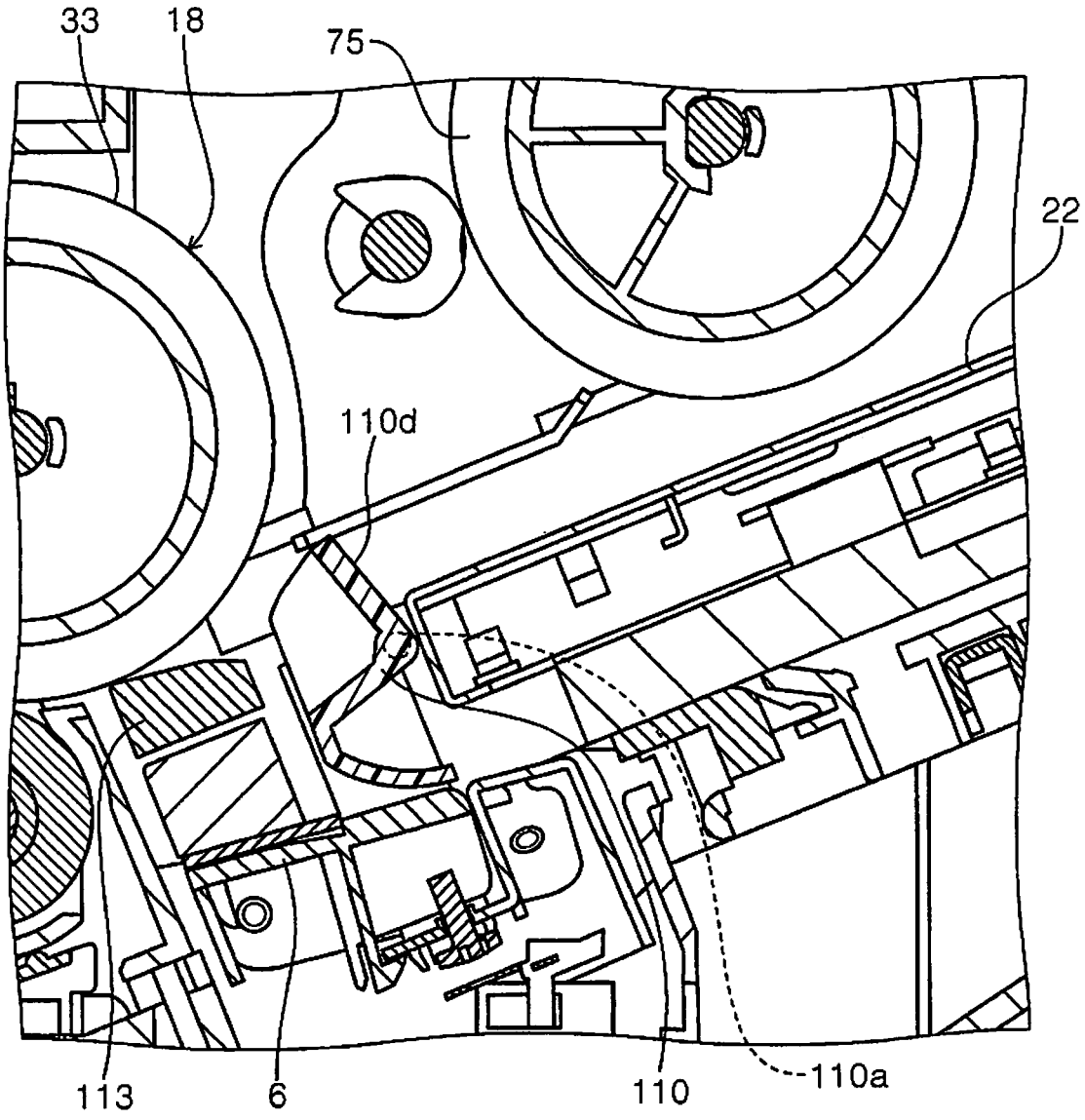
FIG. 13 is a cross-sectional view illustrating the front side of the feed unit according to the other embodiment.
Figure 14:
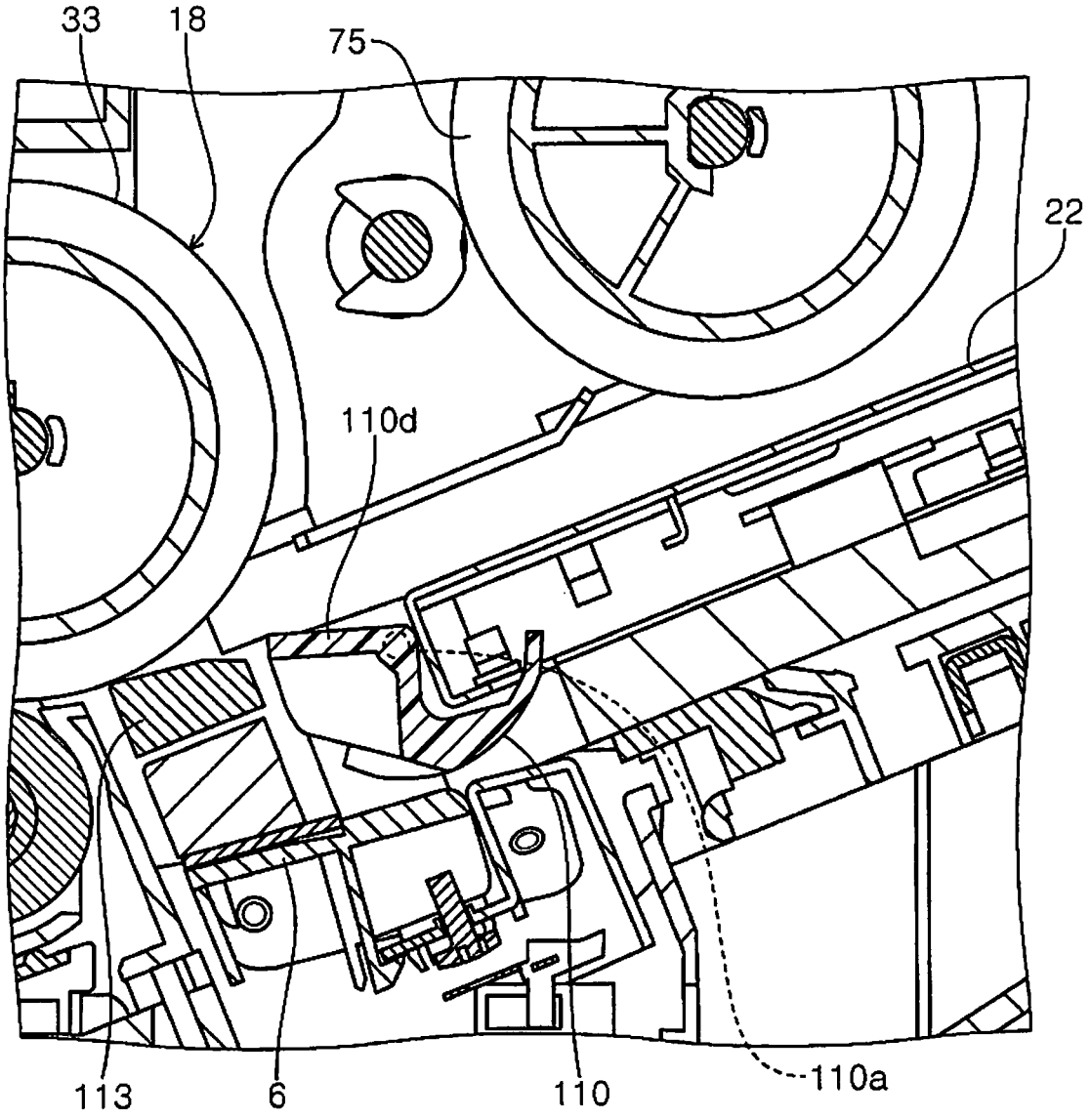
FIG. 14 is a cross-sectional view illustrating the front side of the feed unit according to the other embodiment.
Figure 15:
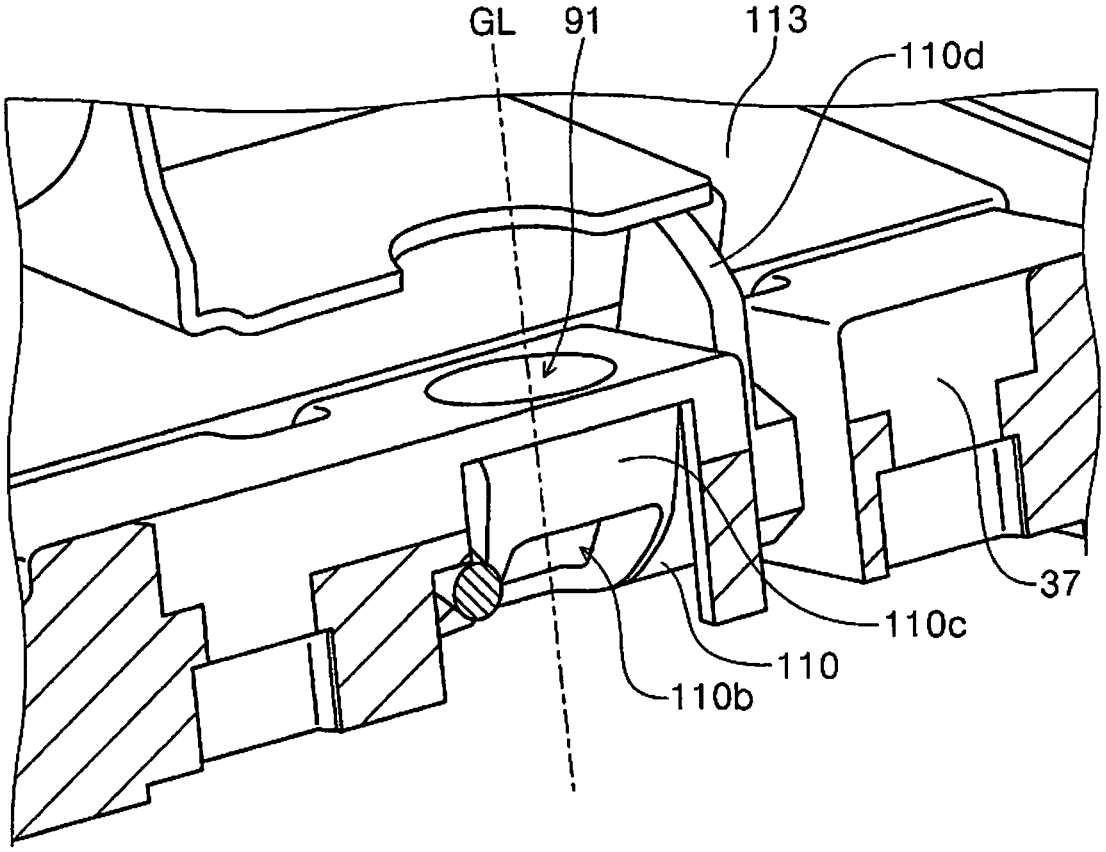
FIG. 15 is a partially enlarged perspective view illustrating the front side of the feed unit according to the other embodiment.
Figure 16:
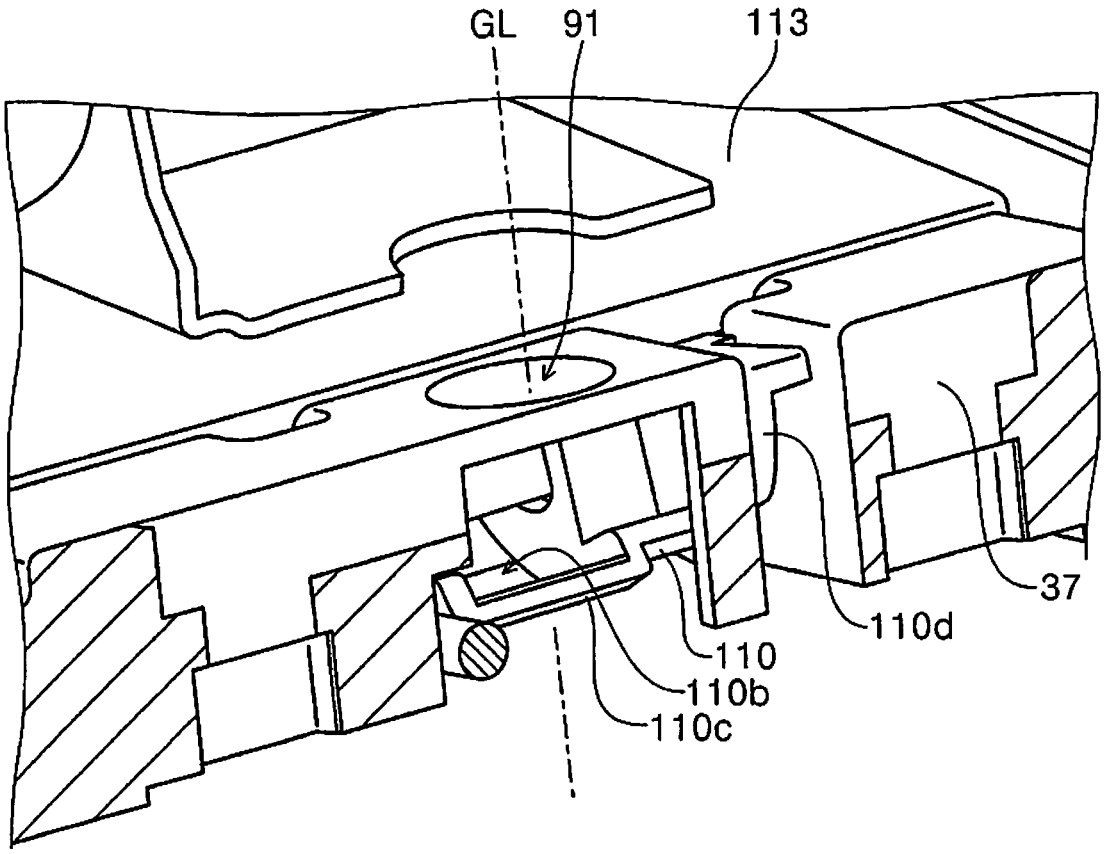
FIG. 16 is a partially enlarged perspective view illustrating the front side of the feed unit according to the other embodiment.

The sensor lever 110 includes a rotary shaft 110*a* (FIGS. 13 and 14) that is rotatably provided at the center, a contact portion 110*d* that projects upward of the placement surface 22 from a rotary shaft 110*a* in a state (a non-feeding state of the medium P) in FIGS. 11, 13, and 15, an opening 110*b* (FIG. 15), and a screening portion 110*c* (FIGS. 15 and 16).

The sensor lever 110 maintains a state in FIGS. 11, 13, and 15 by a spring (not illustrated), that is, a state in which the contact portion 110*d* projects upward of the placement surface 22, in the non-feeding state of the medium P.

A line GL in FIGS. 15 and 16 represents an optical axis of the second optical sensor 32, in the feeding standby state illustrated in FIG. 15, the optical axis GL passes through the opening 110*b* of the sensor lever 110, that is, the sensor lever 110 is configured not to cover the optical axis GL. In this state, the intensity of reflected light of the detection light emitted from the second optical sensor 32 to the second optical sensor 32 is very low or zero, and thereby the control unit 19 (FIG. 1) that performs various types of control can detect that the medium P is not fed.

Then, when the frontmost medium P on the feeding side starts to be fed from the feeding standby state, the front end of the medium P pushes the contact portion 110*d* down, and thereby the sensor lever 110 rotates. FIGS. 14 and 16 illustrate a state in which the contact portion 110*d* is pushed down by the medium P, and in this state, the screening portion 110*c* blocks the optical axis GL as illustrated in FIG. 16. In the embodiment, the sensor lever 110 is entirely and integrally formed of a resin material; however, the sensor lever is formed of a white resin. Therefore, when the screening portion 110*c* blocks the optical axis GL, the intensity of the reflected light of the detection light emitted from the second optical sensor 32 to the second optical sensor 32 is high. In this manner, the control unit 19 (FIG. 1) that performs various types of control can detect that the medium P is fed.

Operation effects of the configuration described above are as follows. In a case where the feed unit 210 is installed, a length of the optical path of the detection light, which is emitted from the second optical sensor 32 and is reflected, is longer, compared to a case where the feed unit 210 is not installed. Therefore, in a state in which the feed unit 210 is installed, there is a concern that it is not possible to appropriately detect the feeding of the medium P, and there is a concern that appropriate feeding control will not performed.

The sensor lever 110 described above is provided between the second penetrating opening 91 and the second optical sensor 32, and the length of the optical path of the detection light, which is emitted from the second optical sensor 32 and is reflected, is shortened by the screening portion 110*c*. In this manner, it is possible to appropriately detect the feeding of the medium P in a state in which the feed unit 210 is installed.

Next, the feed unit 210 includes a pushing-up member 113 as illustrated in FIGS. 11 to 14 and 17 to 20. The pushing-up member 113 is provided to be capable of being displaced with respect to the base frame 37 in the vertical direction.

In a state in which the feed unit 210 is installed in the processing apparatus 1, the pushing-up member 113 is pushed upward by a lifter 6 provided in the processing apparatus 1.

To be more specific, although the lifter 6 is illustrated in FIG. 4, the lifter 6 pushes up the medium P placed on the manual feeding medium tray 7 and causes the medium P to abut on the feed roller 33. Incidentally, in a case where the feed unit 210 is installed, it is not possible for the lifter 6 to directly push up the medium P that is fed out from the feed unit 210, and contact pressure of the medium P that is fed out from the feed unit 210 against the feed roller 33 is not sufficient. Thus, there is a concern that it is not possible to appropriately feed out the medium P. Additionally, it is difficult to perform accurate dimension control in order to obtain appropriate contact pressure of the medium P that is fed out from the feed unit 210 against the feed roller 33. Even when accurate dimension control is performed, excessive contact pressure is generated depending on a thickness of the medium P, and thus there is a concern of non-feeding.

Figure 17:
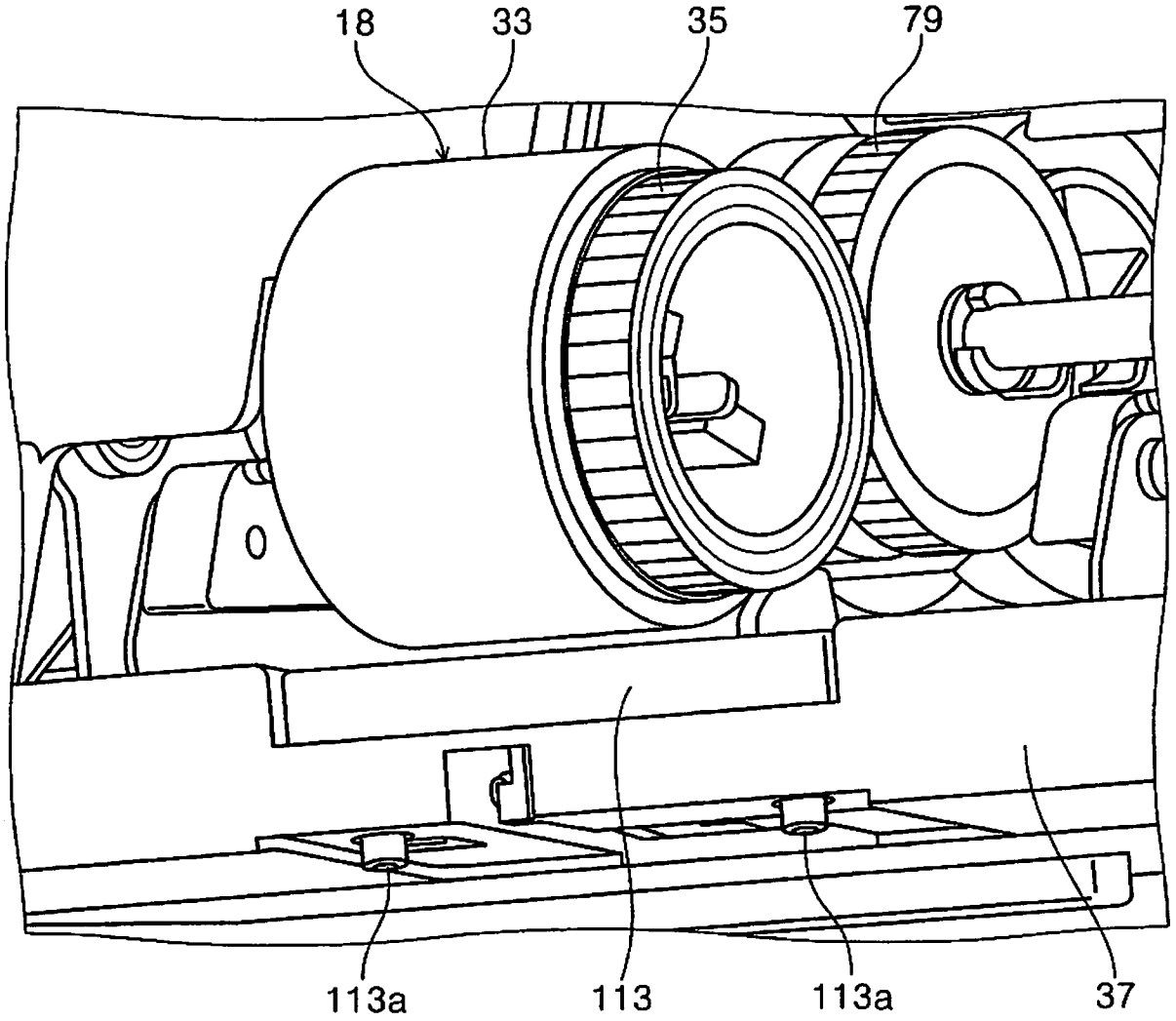
FIG. 17 is a partially enlarged perspective view illustrating the front side of the feed unit according to the other embodiment.
Figure 18:
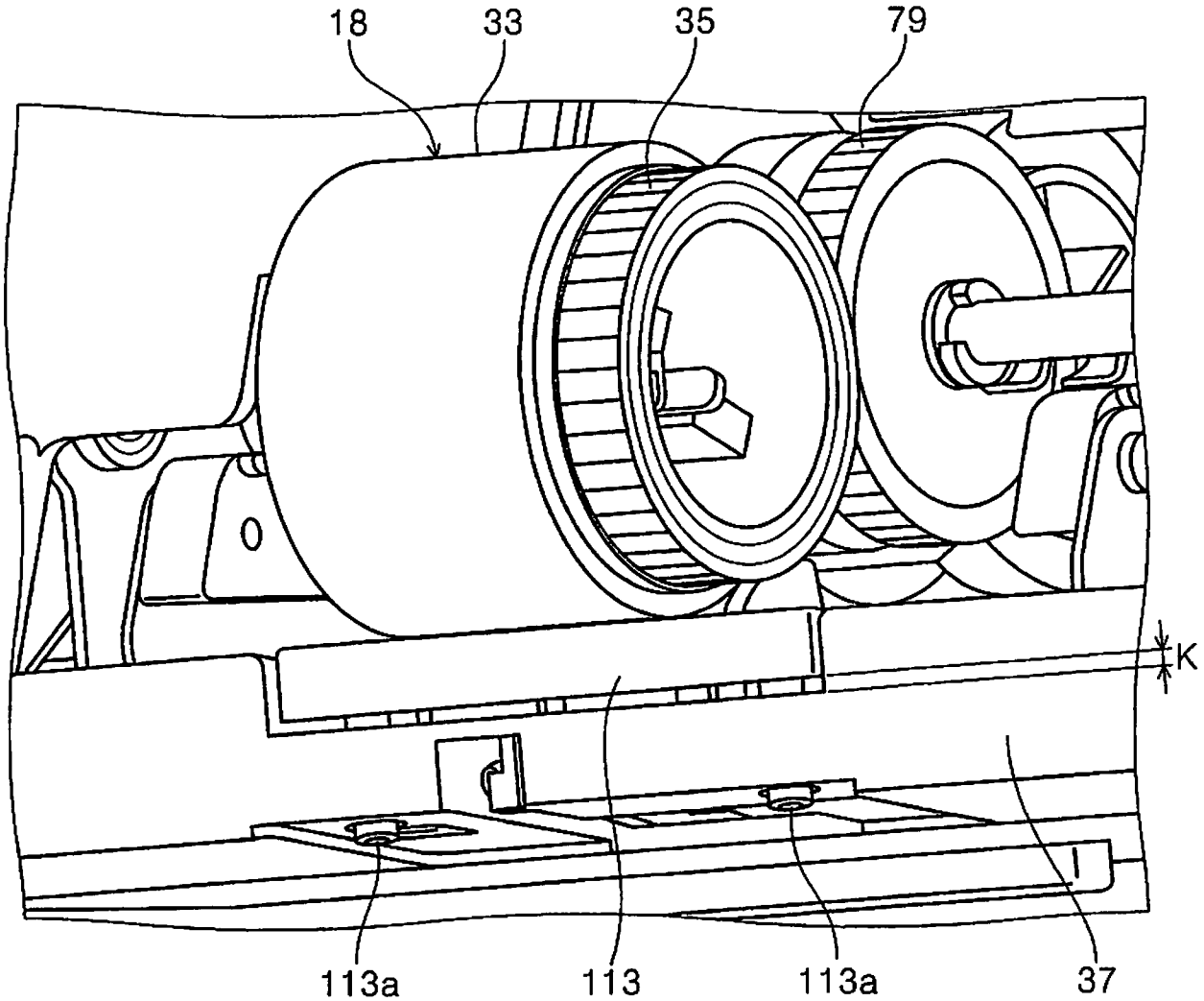
FIG. 18 is a partially enlarged perspective view illustrating the front side of the feed unit according to the other embodiment.
Figure 19:
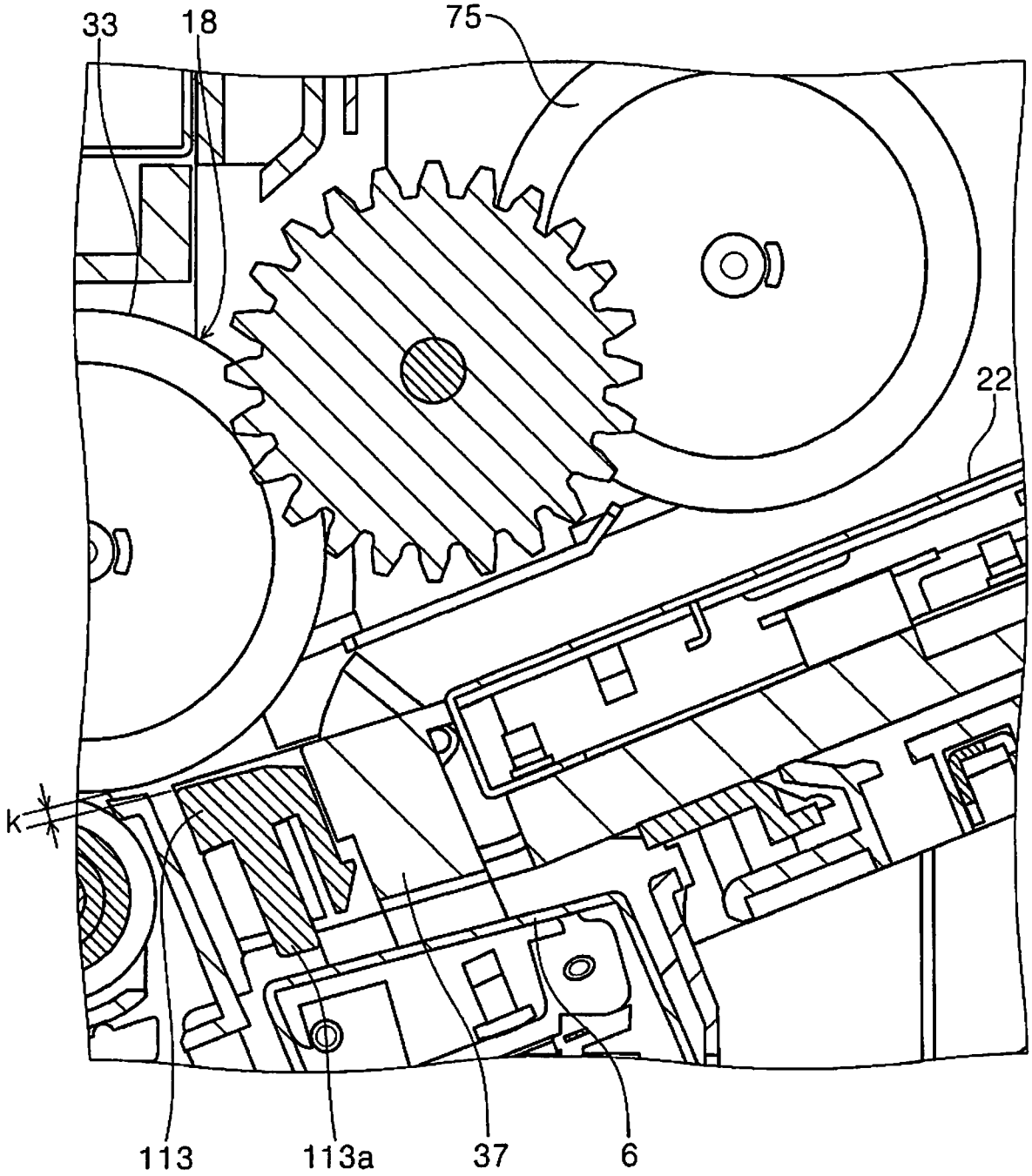
FIG. 19 is a cross-sectional view illustrating the front side of the feed unit according to the other embodiment.
Figure 20:
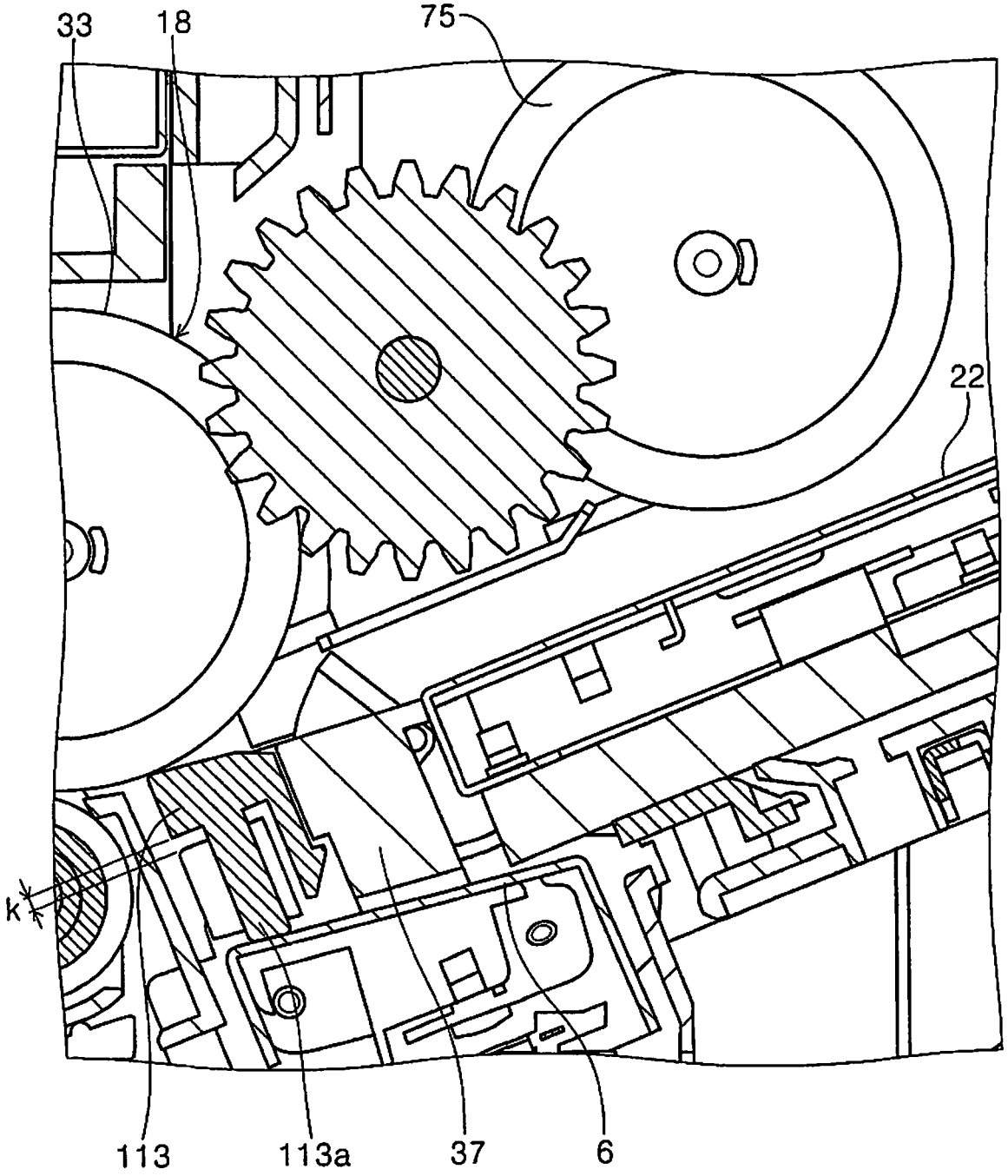
FIG. 20 is a cross-sectional view illustrating the front side of the feed unit according to the other embodiment.

Thus, the pushing-up member 113 is provided in the feed unit 210, the lifter 6 pushes up the pushing-up member 113 as illustrated in a change from FIG. 17 to FIG. 18 and a change from FIG. 19 to FIG. 20, the medium P that is fed out from the feed unit 210 is pushed up via the pushing-up member 113. In this manner, even in a case where the feed unit 210 is installed, it is possible to appropriately secure the contact pressure of the medium P against the feed roller 33 and to appropriately feed out the medium P. In other words, in cases where the feed unit 210 is not installed and is installed, it is possible to obtain equalized feeding force of the medium P by the feed roller 33.

The pushing-up member 113 can be formed of various materials; however, when the last medium P set on the feed unit 210 is fed, the medium comes into direct contact with the feed roller 33. Therefore, it is preferable that the medium be formed of a material having a significantly low coefficient of friction to the extent that a high load is not applied to rotation of the feed roller 33. In addition, for this reason, a part of the pushing-up member 113, which comes into contact with the feed roller 33, is appropriate to be configured of a driven roller.

A reference sign 113*a* in FIG. 17 represents a protrusion that protrudes downward from the base frame 37. The protrusion 113*a* is pushed up by the lifter 6, and the pushing-up member 113 is displaced upward. A dimension k in FIGS. 18 to 20 represents a dimension in which the pushing-up member 113 is capable of being vertically displaced.

Figure 12:
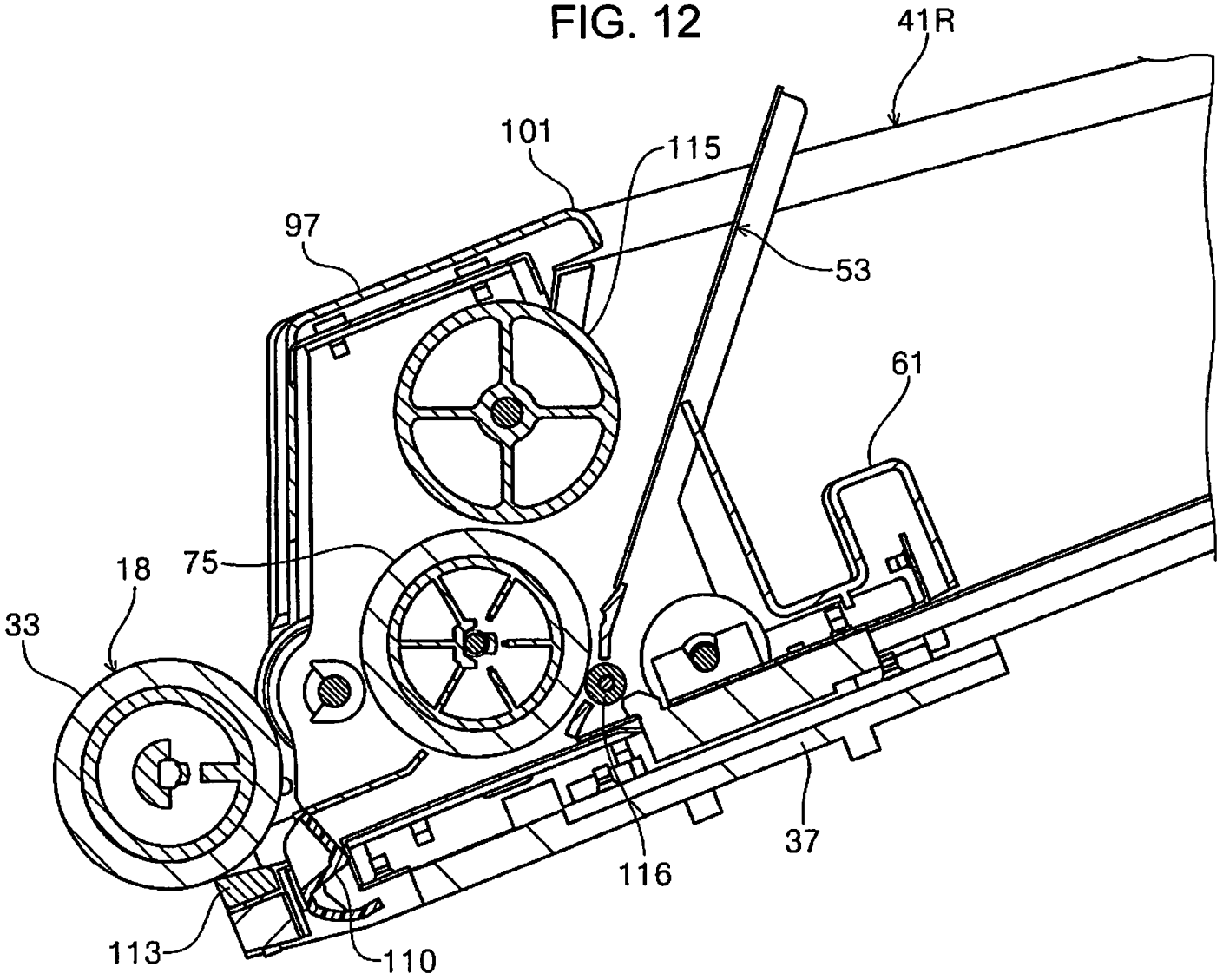
FIG. 12 is a cross-sectional view illustrating the front side of the feed unit according to the other embodiment.

Next, the feed unit 210 includes a second roller 115 above (upstream of) the first roller 75 as illustrated in FIG. 12. In a configuration in which the second roller 115 is provided, there is a concern that the medium P having the side placed posture, which is positioned at the position S to start feeding, will have a posture of falling onto the first roller 75 and, as a result, there is a concern that the medium P will be in excessive contact with the protruding portion 101 of the housing 97 and a transport load is increased. The feed unit 210 includes the second roller 115 above (upstream of) the first roller 75, and thus it is possible to appropriately maintain the side placed posture of the medium P and to suppress such a problem.

The second roller 115 may be configured to come into contact with the medium P and to be rotatably driven without transmission of the drive force or may be configured to rotate on its own with transmission of the drive force. In this case, for example it is suitable to employ a configuration in which the drive of the second roller 115 is performed by obtaining a drive force from the second intermediate gear 85 (FIG. 6) that rotates to be coaxial to the first roller 75, in terms of suppression of costs and suppression of a size increase.

Next, a feed unit 211 according to still another embodiment will be described with reference to FIG. 21. The feed unit 211 differs from the feed unit 21 according to the first embodiment described above in a configuration around the first roller.

Figure 21:
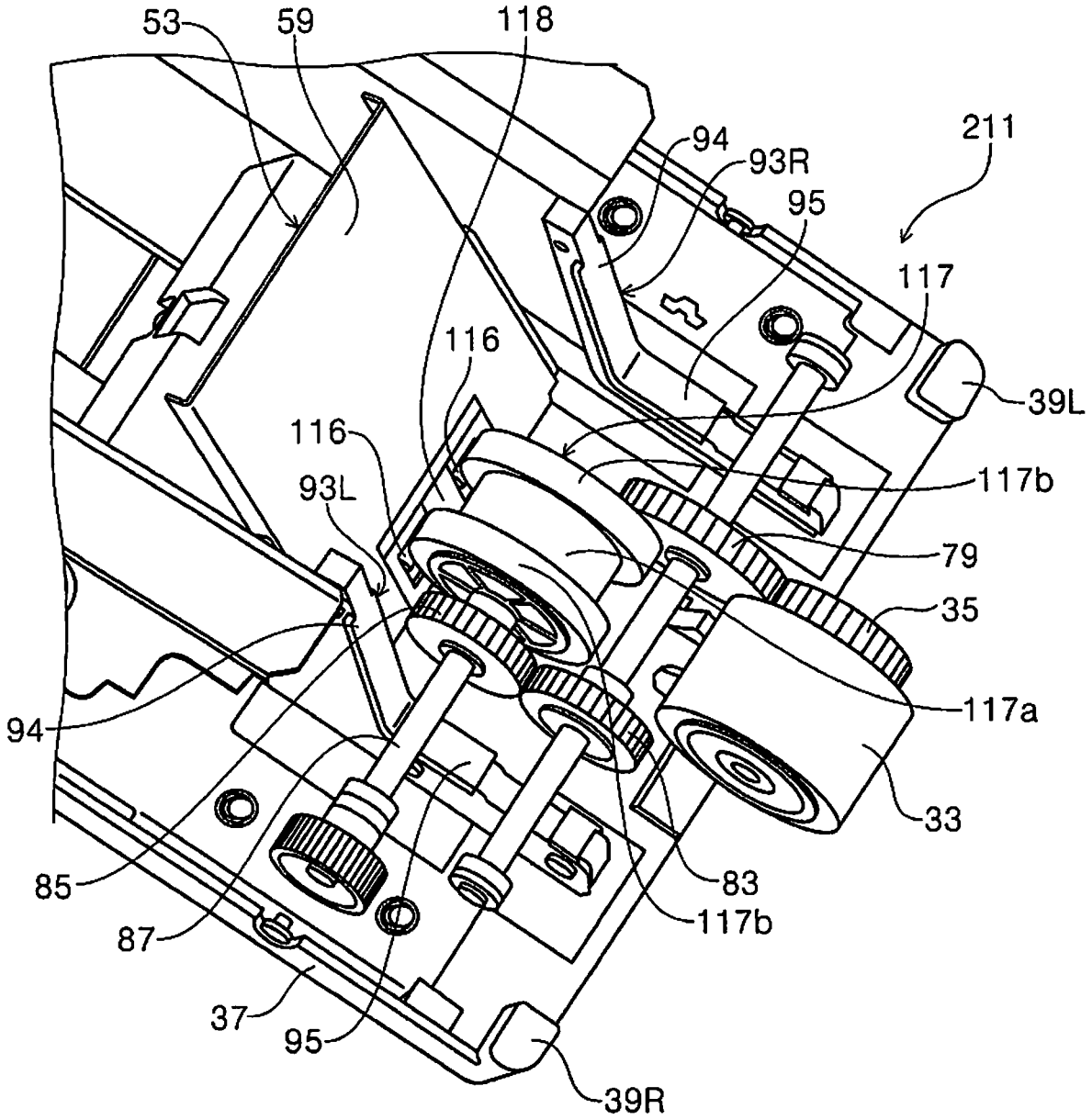
FIG. 21 is a perspective view illustrating the front side of the feed unit according to the other embodiment.

A first roller 117 illustrated in FIG. 21 differs from the first roller 75 described above in that the roller has two roller portions 117*b* in a main body portion 117*a*. The roller portion 117*b* is provided to have an interval with respect to the main body portion 117*a* in a rotation axis direction, and the roller portion 117*b* is configured to come into contact with the medium P. The main body portion 117*a* can be formed of a resin material, and the roller portion 117*b* can be formed of an elastic material such as an elastomer.

A driven roller 116 is provided at a position opposite to the roller portion 117*b* in the holding unit 53 (refer to FIG. 12). In addition, a friction pad 118 is provided between the two driven rollers 116 in the holding unit 53. The friction pad 118 is formed of a high friction material such as cork or elastomer and has a function of holding, in a way that the medium P does not proceed to the downstream side the media P other than the medium being fed of the media P that are supported by the holding unit 53 in the side placed posture. The friction pad 118 does not come into contact with the roller portion 117*b* that configures the first roller 117.

Here, in the feed unit 21 illustrated in FIG. 5, the friction pad 54 is wide in the width direction of the medium P and is configured to be disposed to come into contact with the first roller 75. In a case of such a configuration, when the last medium P is fed, the first roller 75 and the friction pad 54 come into contact with each other, and there is a concern that a high load will be applied to the motor that drives the first roller 75, and there is a concern that a change in load occurring on a motor on the side of the processing apparatus 1 will result in an adverse effect on a recording quality in a configuration in which the feed unit obtains power from the side of the processing apparatus 1.

By comparison, in the feed unit 211 according to the embodiment illustrated in FIG. 21, the friction pad 118 does not come into contact with the roller portion 117*b* of the first roller 117 as described above, but the roller portion 117*b* comes into contact with the driven roller 116 that can be rotatably driven. Therefore, even when the last medium P is fed, there is a concern that a high load will be applied to the motor that drives the first roller 117.

What is claimed is:

1. A processing apparatus comprising:

a processing unit that performs a predetermined process on a medium;

a placement unit on which the medium is placed in a first posture;

a medium feeding unit that feeds the medium from the placement unit toward the processing unit; and a feed unit that is detachably disposed on the placement unit, wherein the feed unit causes the medium to be placed in a second posture which is different from the first posture, the feed unit includes a base frame and a pair of guide portions, the guide portions guide side ends of the medium that has the second posture and is placed on the base frame between the guide portions, both of the guide portions are disposed on the base frame and are movable on the base frame in an approaching direction in which the guide portions approach toward the side ends of the medium and a separating direction in which the guide portions move apart from the side ends of the medium, and each of the guide portions includes a downstream side end portion and an upstream side end portion in a feeding direction of the medium having the second posture, and a height of the downstream side end portion from a placement surface of the base frame of the feed unit is greater than a height of the upstream side end portion from the placement surface of the base frame of the feed unit.

2. A processing apparatus comprising:

a processing unit that performs a predetermined process on a medium;

a placement unit that causes the medium to be placed thereon;

a medium feeding unit that feeds the medium from the placement unit toward the processing unit; and a feed unit that is detachably disposed on the placement unit, the feed unit including a roller that feeds the medium toward the medium feeding unit, wherein the placement unit causes the medium to be placed in a first posture in which a surface of the medium is placed along a placement surface of the placement unit, the feed unit causes the medium to be placed in a second posture which is different from the first posture and in which, of four sides of the medium, an end side on a downstream side in a transport direction is brought into contact with a placement surface of the feed unit and the medium is inclined, the medium having the first posture is fed out by the medium feeding unit in a state in which the surface of the medium is placed along the placement surface of the placement unit, when the medium having the second posture moves to a position of the roller and passes through the position of the roller, with the end side of the medium on the downstream side sliding on the placement surface of the feed unit, the posture of the surface of the medium changes along the placement surface of the feed unit, and the medium is fed to the medium feeding unit by the roller, and the roller rotates, with power transmitted thereto from the medium feeding unit.

3. The processing apparatus according to claim 2, wherein the feed unit is configured to have projecting portions on a surface on a side on which the feed unit is in contact with the placement surface of the placement unit, and to be positioned with the projecting portions fitted into recessed portions formed in the placement surface of the placement unit.

4. The processing apparatus according to claim 3, further comprising:

a pair of first guide portions that guides side ends of the medium having the first posture and is movable in an approaching direction in which the first guide portions approach to each other and a separating direction in which the first guide portions move apart from each other, wherein the recessed portions are a pair of grooves that guides movement of the first guide portions, and wherein the projecting portions are a pair of protrusions which are present at positions corresponding to the pair of grooves.

5. The processing apparatus according to claim 4, wherein the feed unit is disposed at a position interposed between the pair of first guide portions.

6. The processing apparatus according to claim 2, wherein the feed unit includes a holding unit that causes the medium to hold the second posture, and wherein the holding unit is configured to be movable in a direction in which the holding unit approaches or is separated from the medium feeding unit, and to move toward the medium feeding unit whenever one of media in the second posture is fed out by a force of a pressing unit.

7. The processing apparatus according to claim 6, wherein the feed unit has a base frame with a locking hole, the holding unit has a locking hook that is detachably engageable with the locking hole, and while the locking hook is engaged with the locking hole, the holding unit is fixable at a predetermined position at which the holding unit is apart from the medium feeding unit.

8. The processing apparatus according to claim 6, further comprising:

a first optical sensor that performs detection based on irradiation light and reflected light and is disposed on the placement surface of the placement unit; and a first penetrating opening at a position of the holding unit of the feed unit, which corresponds to an optical path of the irradiation light, wherein the first optical sensor detects that the medium is placed on the feed unit, based on the reflected light with respect to the irradiation light, via the first penetrating opening.

9. The processing apparatus according to claim 8, further comprising:

a second optical sensor that is disposed on a downstream side in a feeding direction from the first optical sensor and on the placement surface of the placement unit and performs detection based on irradiation light and reflected light; and a second penetrating opening that is disposed on the downstream side from the first penetrating opening of the feed unit, wherein the second optical sensor detects that feeding of the medium is started by the feed unit, based on the reflected light with respect to the irradiation light, via the second penetrating opening.

10. The processing apparatus according to claim 6, wherein the feed unit includes a pair of second guide portions that guides side ends of the medium having the second posture and is movable in an approaching direction in which the second guide portions approach toward the side ends of the medium and a separating direction in which the second guide portions move apart from the side ends of the medium.

11. The processing apparatus according to claim 10, wherein each of the second guide portions includes a downstream side end portion and an upstream side end portion in a feeding direction of the medium having the second posture, and a height of the downstream side end portion from a placement surface of the feed unit is greater than a height of the upstream side end portion from the placement surface of the feed unit.

12. The processing apparatus according to claim 2, wherein the feed unit includes a holding unit that causes the medium to hold the second posture, wherein the placement surface of the feed unit is provided with a downward inclined surface toward the medium feeding unit in a state in which the feed unit is disposed on the placement unit, and wherein the holding unit moves down on the inclined surface whenever one of media having the second posture is fed out by an own weight of the holding unit.

13. The processing apparatus according to claim 2, wherein the medium feeding unit has a first gear on a shaft of a feed roller which is one constituent member, wherein the feed unit has a second gear, wherein the first gear and the second gear intermesh with each other with the feed unit disposed on the placement unit, and wherein the roller rotates, with power from the medium feeding unit transmitted thereto via the first gear and the second gear.

14. The processing apparatus according to claim 2, wherein the feed unit includes a side edge floating restrainer that restrains a side edge of the medium from floating when the medium having the second posture is fed out.

15. The processing apparatus according to claim 2, wherein the feed unit includes a center floating restrainer that restrains the central portion of the medium in a width direction from floating while the medium having the second posture is being fed out.

16. The processing apparatus according to claim 2, wherein the feed unit includes a center floating restrainer that restrains the central portion of the medium in a width direction from floating, when the medium having the second posture is positioned at a position when feeding of the medium toward the processing unit is started.

17. A feed unit that is detachably disposed on a placement unit of a processing apparatus, the processing apparatus being configured to feed to a processing unit of the processing apparatus a first medium placed on a placement surface of the placement unit in a first posture in which a surface of the first medium is placed along the placement surface of the placement unit and perform a predetermined process on the first medium in a state where the feed unit is detached from the placement unit of the processing apparatus, the processing apparatus being configured to feed to the processing unit of the processing apparatus a second medium placed on the feed unit and perform the predetermined process on the second medium in a state where the feed unit is disposed on the placement unit of the processing apparatus, the feed unit comprising:

a roller that feeds the second medium toward the processing unit of the processing apparatus, wherein the feed unit causes the second medium to be placed in a second posture which is an inclined posture, with an end side on a downstream side in a transport direction of four sides of the medium coming into contact with the feed unit, when the second medium having the second posture moves to a position of the roller and passes through the position of the roller, with the end side of the second medium on the downstream side sliding on a placement surface of the feed unit, a posture of a surface of the second medium changes along the placement surface of the feed unit, and the second medium is fed to the processing unit of the processing apparatus by the roller, and the roller rotates by receiving power from the processing apparatus.

* * * * *